US007594311B2

(12) United States Patent
Resta

(10) Patent No.: US 7,594,311 B2
(45) Date of Patent: Sep. 29, 2009

(54) MATTRESS BORDERING APPARATUS

(75) Inventor: Roberto Resta, Faenza (IT)

(73) Assignee: Resta S.R.L., Faenza (IT)

( * ) Notice: Subject to any disclaimer, the term of this patent is extended or adjusted under 35 U.S.C. 154(b) by 651 days.

(21) Appl. No.: 11/316,810

(22) Filed: Dec. 27, 2005

(65) Prior Publication Data

US 2006/0150401 A1 Jul. 13, 2006

(30) Foreign Application Priority Data

Jan. 7, 2005 (IT) ..... BO2005A0006

(51) Int. Cl.
*B68G 7/00* (2006.01)

(52) U.S. Cl. ..... 29/91; 29/33 K; 29/823; 29/824; 112/2.1

(58) Field of Classification Search ..... 29/91, 29/91.1, 33 E, 33 P, 33 K, 728, 822, 823, 29/824; 112/2.1, 303
See application file for complete search history.

(56) References Cited

U.S. PATENT DOCUMENTS 4,821,656 A 4/1989 Dordi et al.

FOREIGN PATENT DOCUMENTS

EP 0 682 135 A 11/1995

*Primary Examiner*—Essama Omgba
(74) *Attorney, Agent, or Firm*—Modiano & Associati; Albert Josif; Daniel J. O'Byrne

(57) ABSTRACT

An apparatus for bordering mattresses, comprising two mattress bordering assemblies, arranged at upper and at lower levels and provided with superimposed worktables being provided with mattress overturning devices, a mattress distribution assembly arranged upstream of the bordering assemblies to send the mattresses individually to the upper worktable or lower worktable, a chute arranged at the output of the worktable of the upper assembly and inclined to convey the mattresses bordered by the upper assembly toward a receiving table, the chute comprising actuatable movable elements, in order to allow the advancement of the mattresses from the upper worktable toward the receiving table.

9 Claims, 23 Drawing Sheets

MATTRESS BORDERING APPARATUS

The present invention relates to a mattress bordering apparatus.

BACKGROUND OF THE INVENTION

Bordering machines are known which comprise a worktable on which the mattress is turned with respect to a stationary sewing machine, which borders peripherally the longitudinal and transverse sides. The mattress is turned not only manually but also by way of mechanical devices. Devices of this type are known for example from EP-264,618 and EP-682,135 in the name of this same Applicant.

In particular, EP-682,135 also discloses an overturning device, which, after the bordering of one face of the mattress has ended, turns over the mattress in order to allow to border the other face of the mattress.

Current bordering machines have operational limitations, owing to which they are capable of bordering one mattress at a time. The use of several bordering machines in order to increase productivity, however, clashes with the fact that these machines are very bulky and cannot be accommodated in industrial buildings. Moreover, the search for a vertical solution in which bordering machines are stacked on multiple levels, in addition to being often unfeasible due to technical problems, would force operators to work at considerable heights, producing unacceptable safety conditions.

SUMMARY OF THE INVENTION

The aim of the present invention is to provide an apparatus which allows to border a plurality of mattresses simultaneously but has a limited space occupation.

Within this aim, an object of the present invention is to provide an apparatus which is capable of not compromising the working conditions of its operators.

This aim and this and other objects which will become better apparent hereinafter are achieved with an apparatus for bordering mattresses, the characteristics of which are defined in the claims.

BRIEF DESCRIPTION OF THE DRAWINGS

Further characteristics and advantages of the present invention will become better apparent from the following detailed description of a preferred embodiment thereof, illustrated only by way of example in the accompanying drawings, wherein.

DESCRIPTION OF THE PREFERRED EMBODIMENTS

Figure 1:
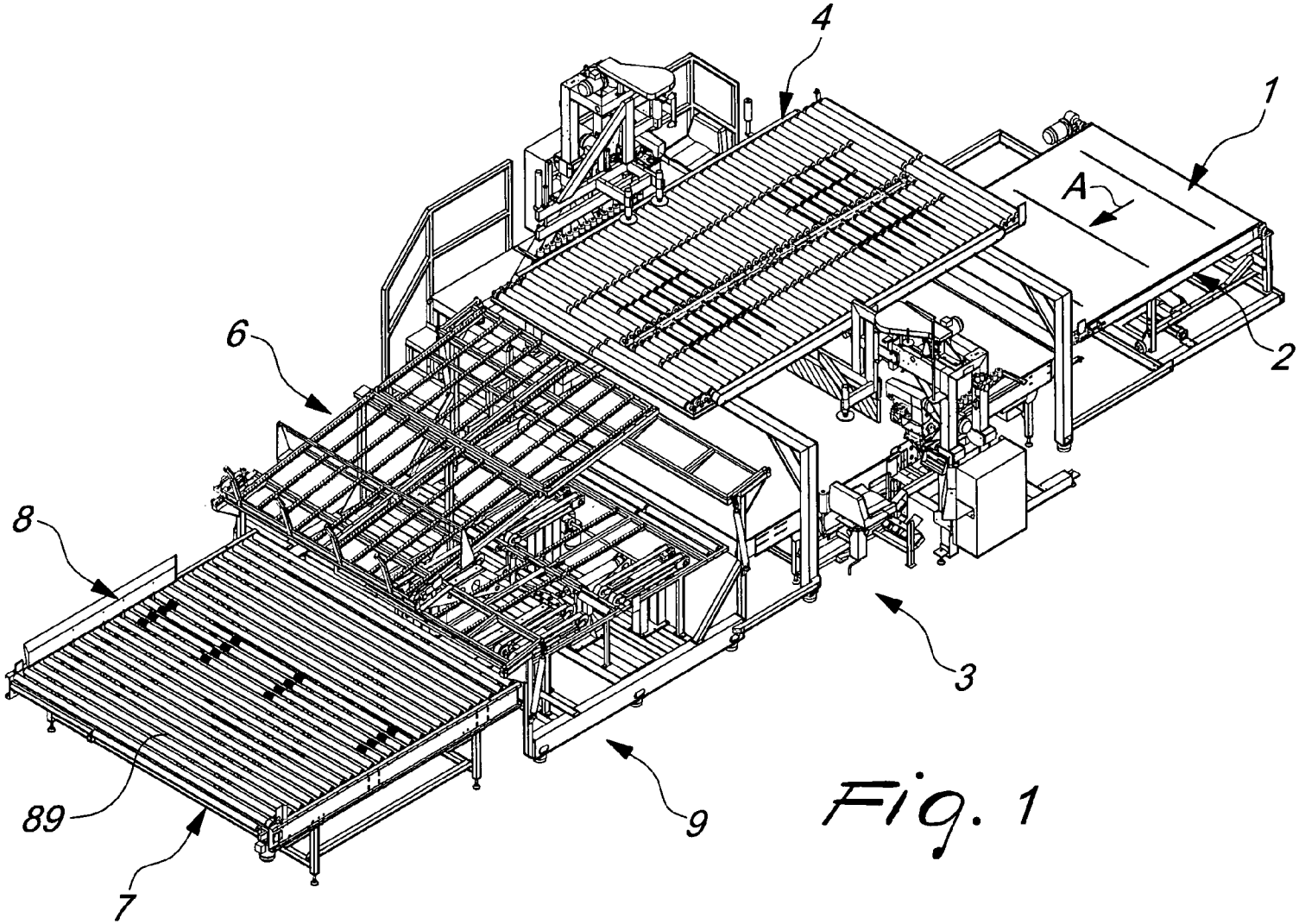
FIG. 1 is a perspective view of the apparatus according to the invention.
Figure 2:
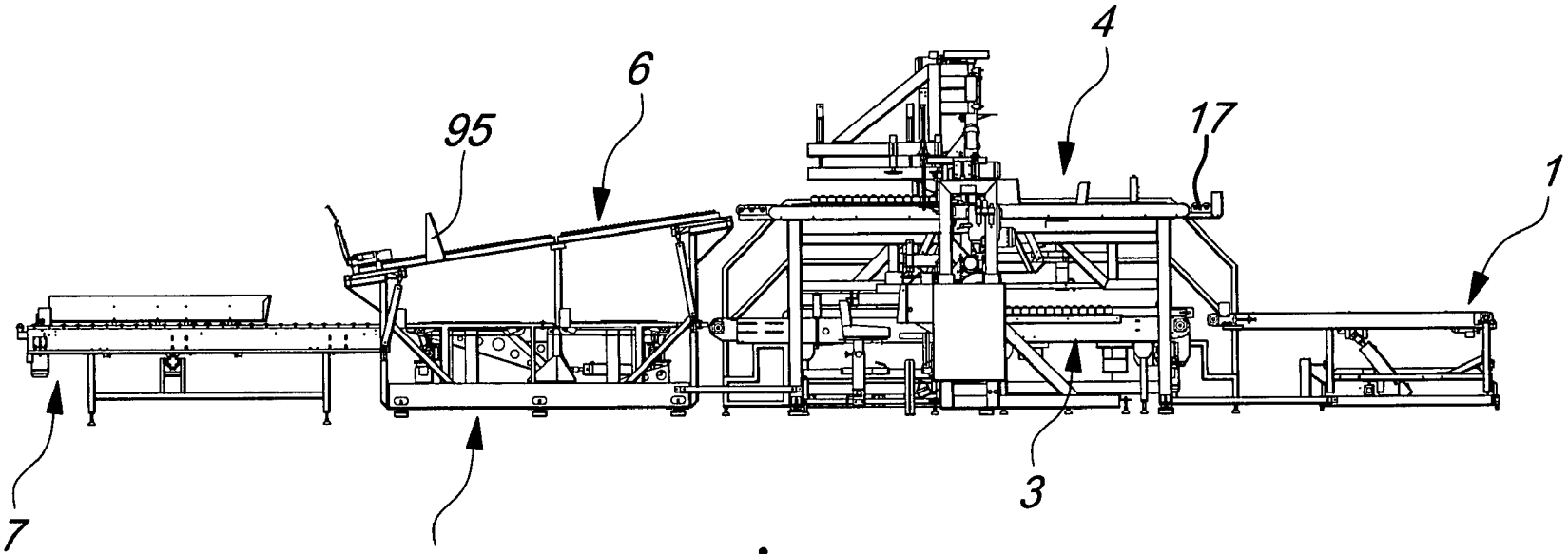
FIG. 2 is a side elevation view of the apparatus.
Figure 3:
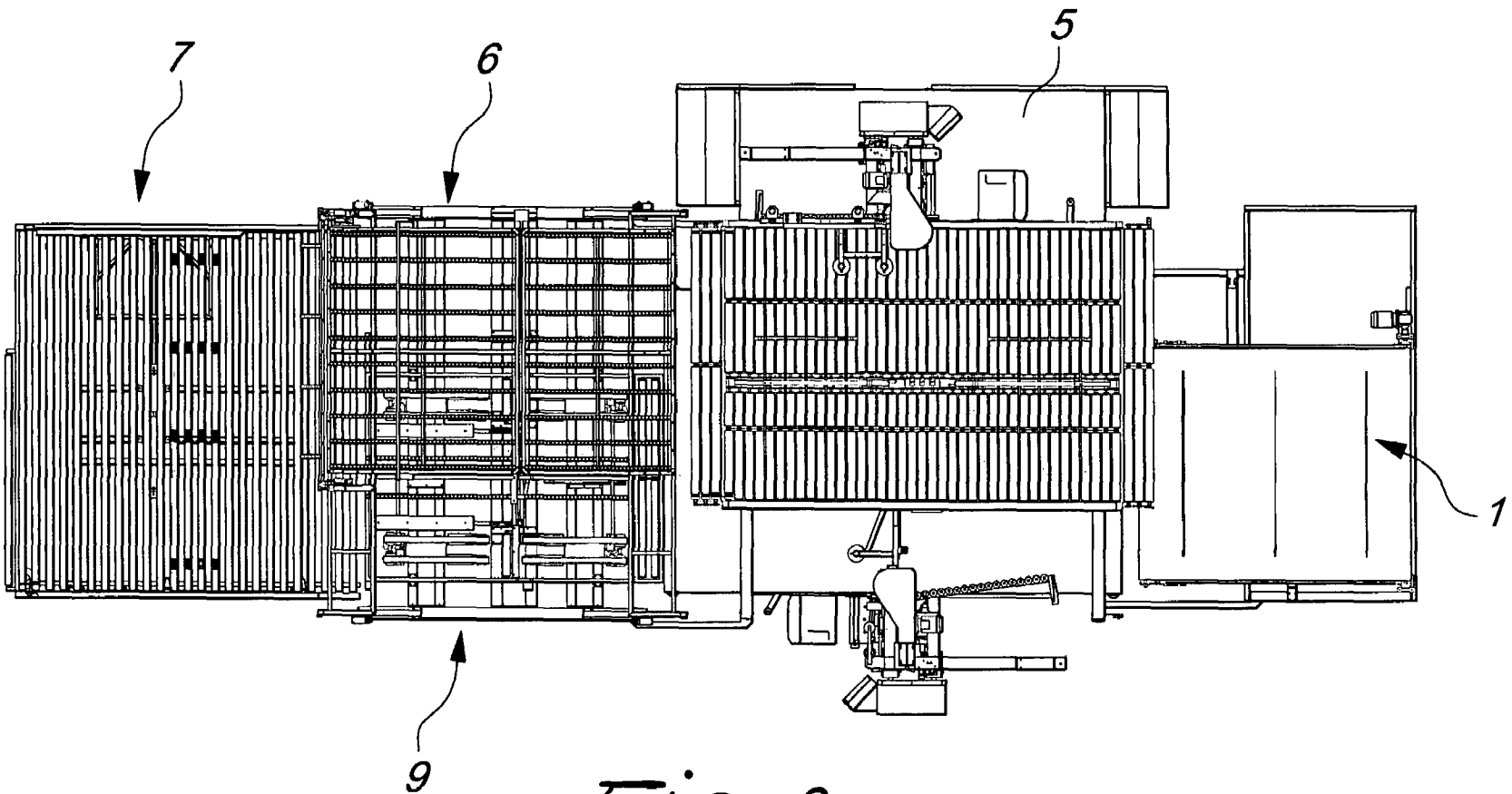
FIG. 3 is a plan view of the apparatus.
Figure 4:
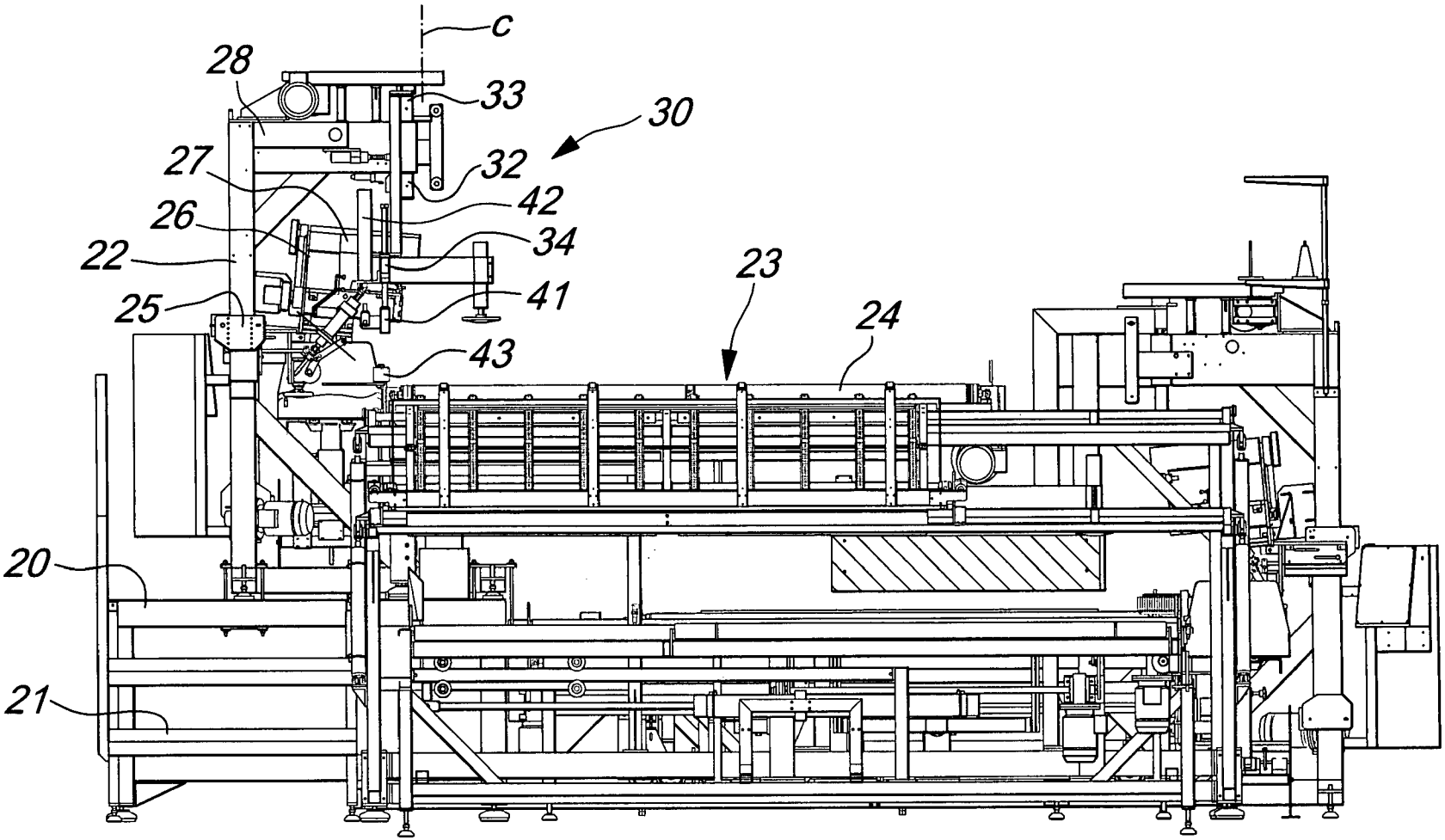
FIG. 4 is a front elevation view of the apparatus.

Before delving into the details, a brief general description of the structure of the apparatus and of its operating method is given.

The apparatus comprises an assembly 1 for distributing mattresses M (see FIGS. 16-19) which have not yet been bordered and are fed by devices which are not illustrated. The assembly 1 comprises an articulated feed table 2, which can be tilted and distributes the mattresses between two mutually superimposed bordering assemblies 3, 4. When the table 2 is horizontal, the mattresses M are conveyed in the direction A to the lower assembly 3, while when the table 2 is inclined, the mattresses M are conveyed to the upper assembly 4.

The assemblies 3 and 4 are provided with horizontal worktables and mattress overturning means, on which the mattresses are moved (turned) in order to be bordered peripherally by way of bordering machines, which in each instance border the upper face of the mattresses.

The upper assembly 4 is equipped with the overturning means comprising an overturning device 5, which is integrated in the worktable and which, when the bordering of the upper face has been completed, turns over the mattress in order to allow the bordering machine to border the other face.

The mattress M bordered by the upper assembly 4 is then transferred, by means of a chute 6, onto a receiving table 7 and is positioned thereon by means of appropriate pusher elements 8.

A device 9 for overturning the mattresses M that is part of the overturning means, is also associated with the lower assembly 3. However, the overturning device 9 is not integrated in the worktable of the assembly 3 but is located at the output thereof. In order to prevent the apparatus from becoming excessively high, the distance between the worktables of the assemblies 3 and 4 is in fact selected constructively as small as possible, to the extent allowed by the operating requirements of the operators, such as accessibility of the components, maintenance and so forth. As is evident, with this reduced distance the space available between the worktables of the assemblies 3 and 4 in order to turn over the mattress that must be bordered in the lower assembly 3 would not be sufficient, also in view of the dimensions of some types of mattress, such as double mattresses.

The overturning device 9 is arranged below the chute 6, which in any case would hinder the overturning of the mattress. However, when a mattress that arrives from the lower assembly 3 after bordering one face arrives at the overturning device 9, the chute 6 opens momentarily in order to form a space which is sufficient to overturn the mattress. Once the mattress has been overturned, it is returned to the worktable of the lower assembly 3 in order to complete the bordering and is then transferred onto the conveyor 8.

Figure 13:
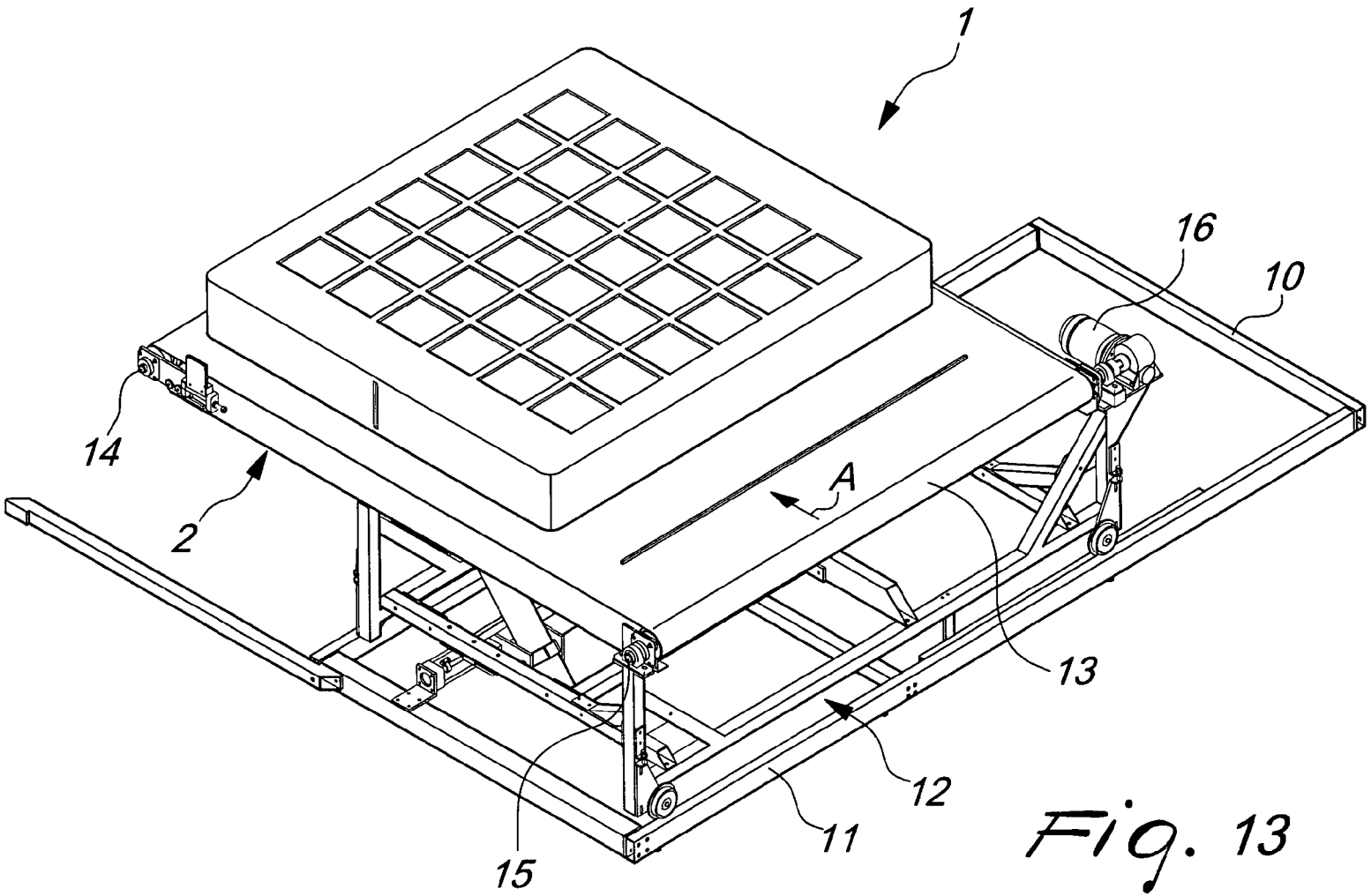
FIG. 13 is a perspective view of the assembly for distributing the mattresses to the lower and upper bordering assemblies.
Figure 14:
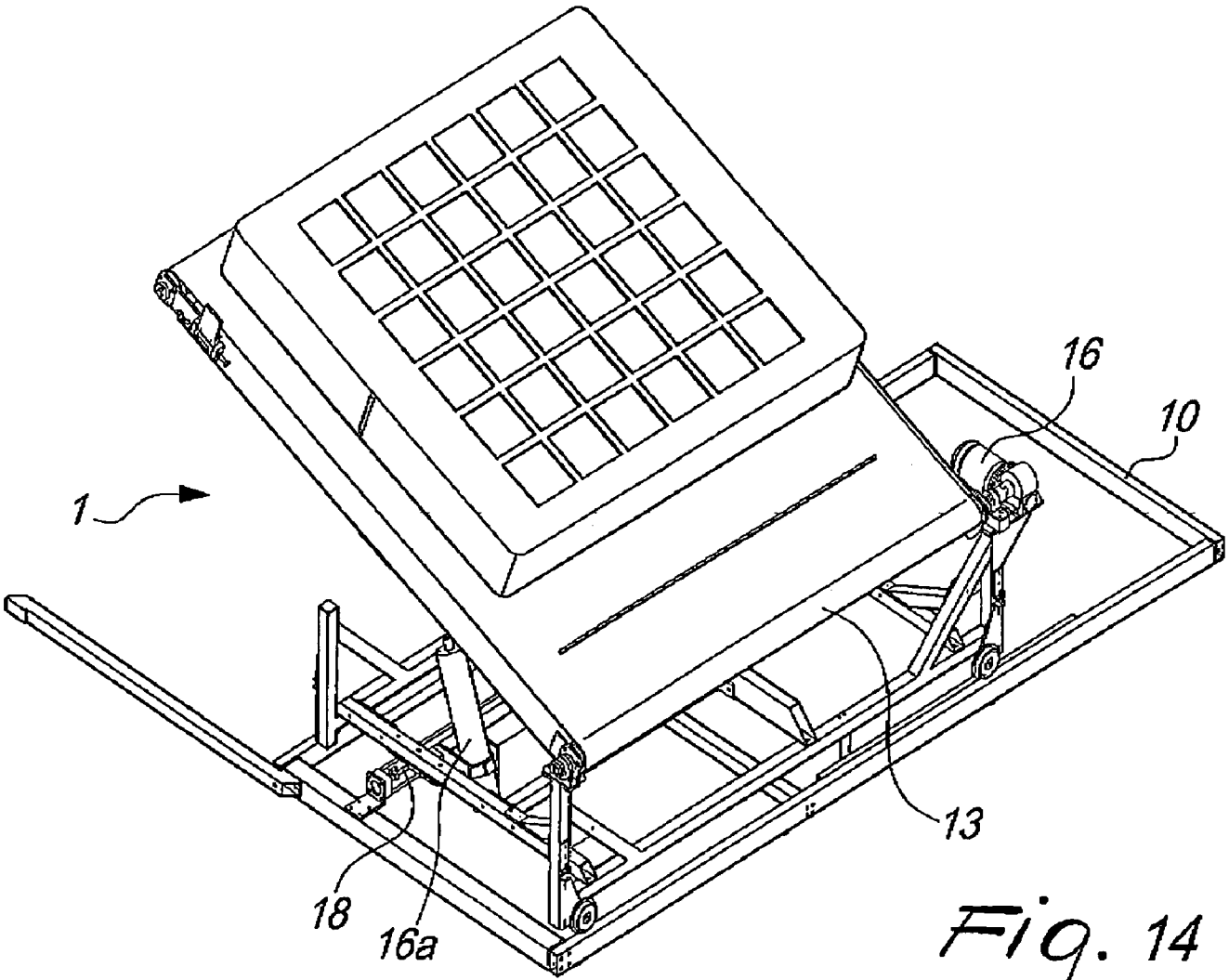
FIG. 14 is a perspective view of the assembly of FIG. 13 in a second operating position.
Figure 15:
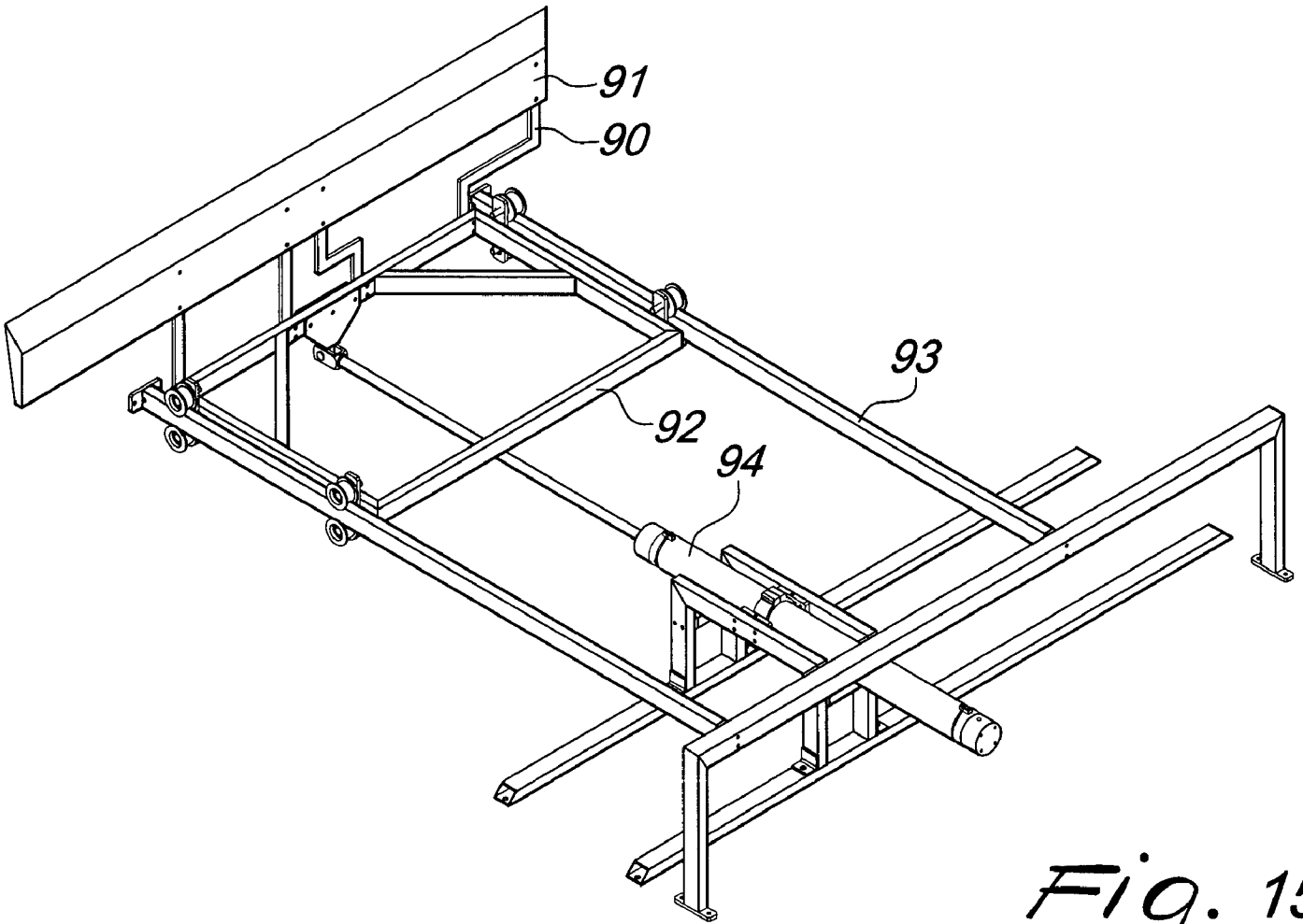
FIG. 15 is a perspective view of the assembly for positioning the mattresses at the output of the apparatus.
Figure 16:
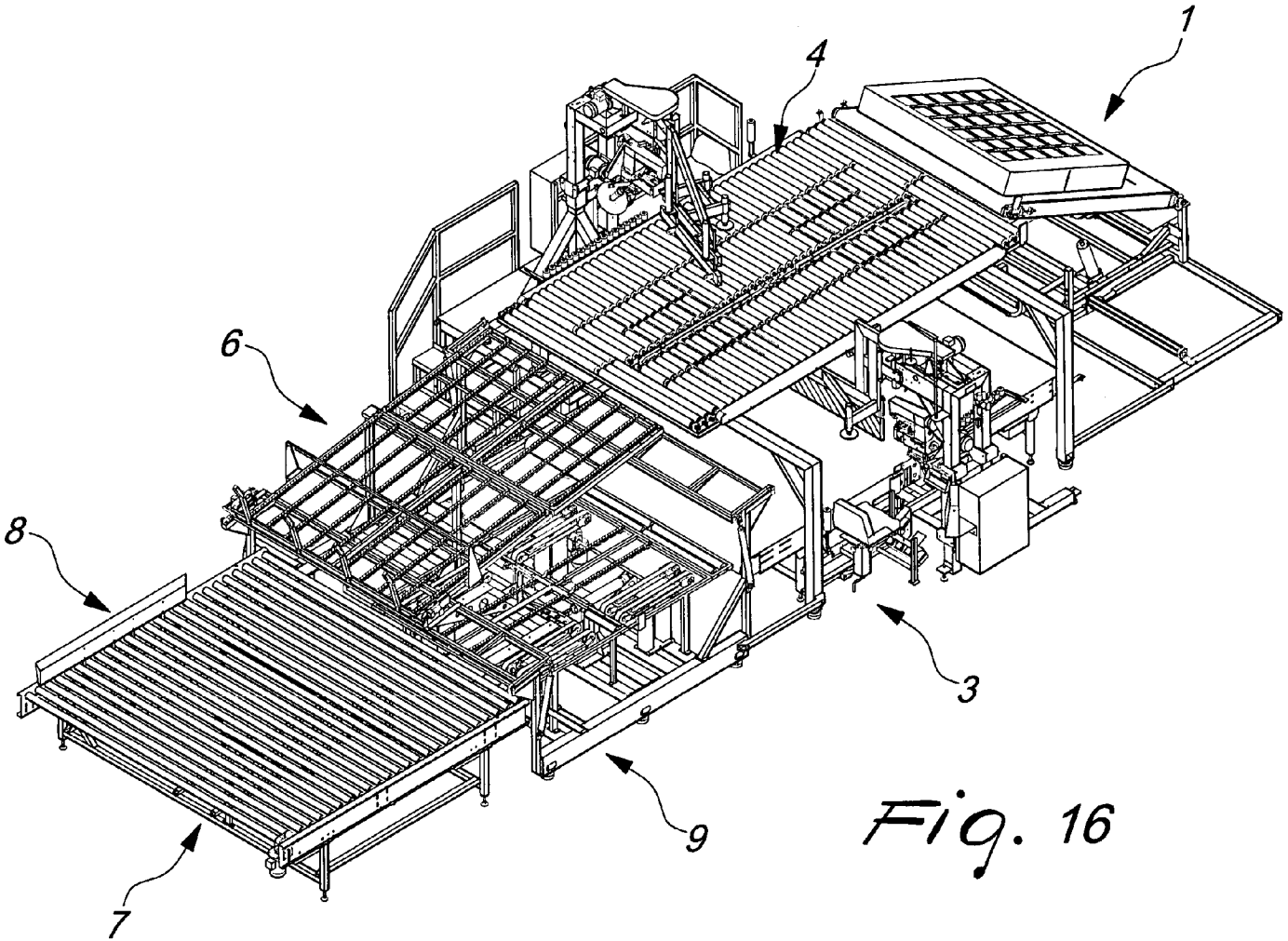
FIGS. 16-19 illustrate an operating sequence of the upper bordering assembly.
Figure 17:
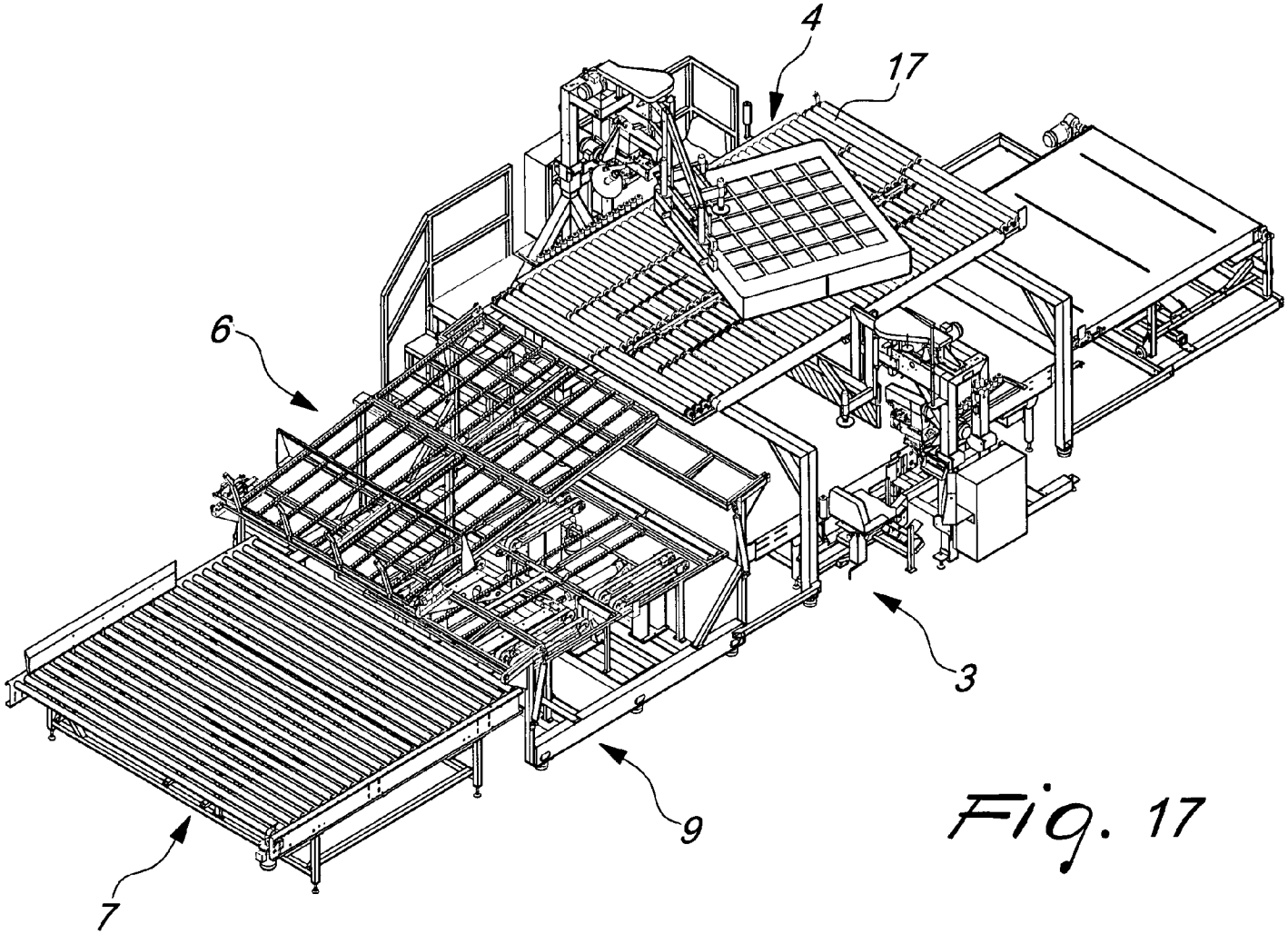
Figure 18:
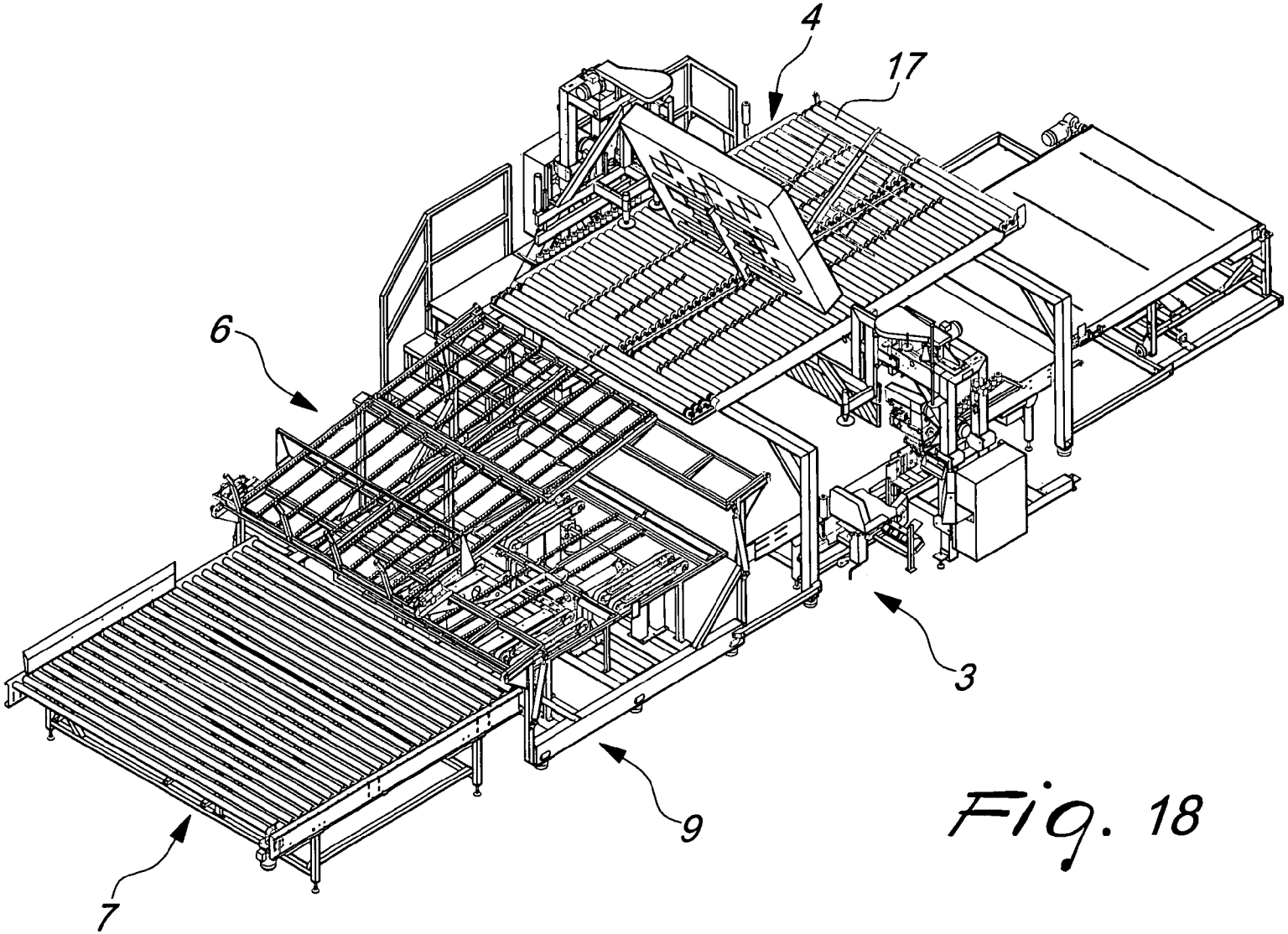
Figure 19:
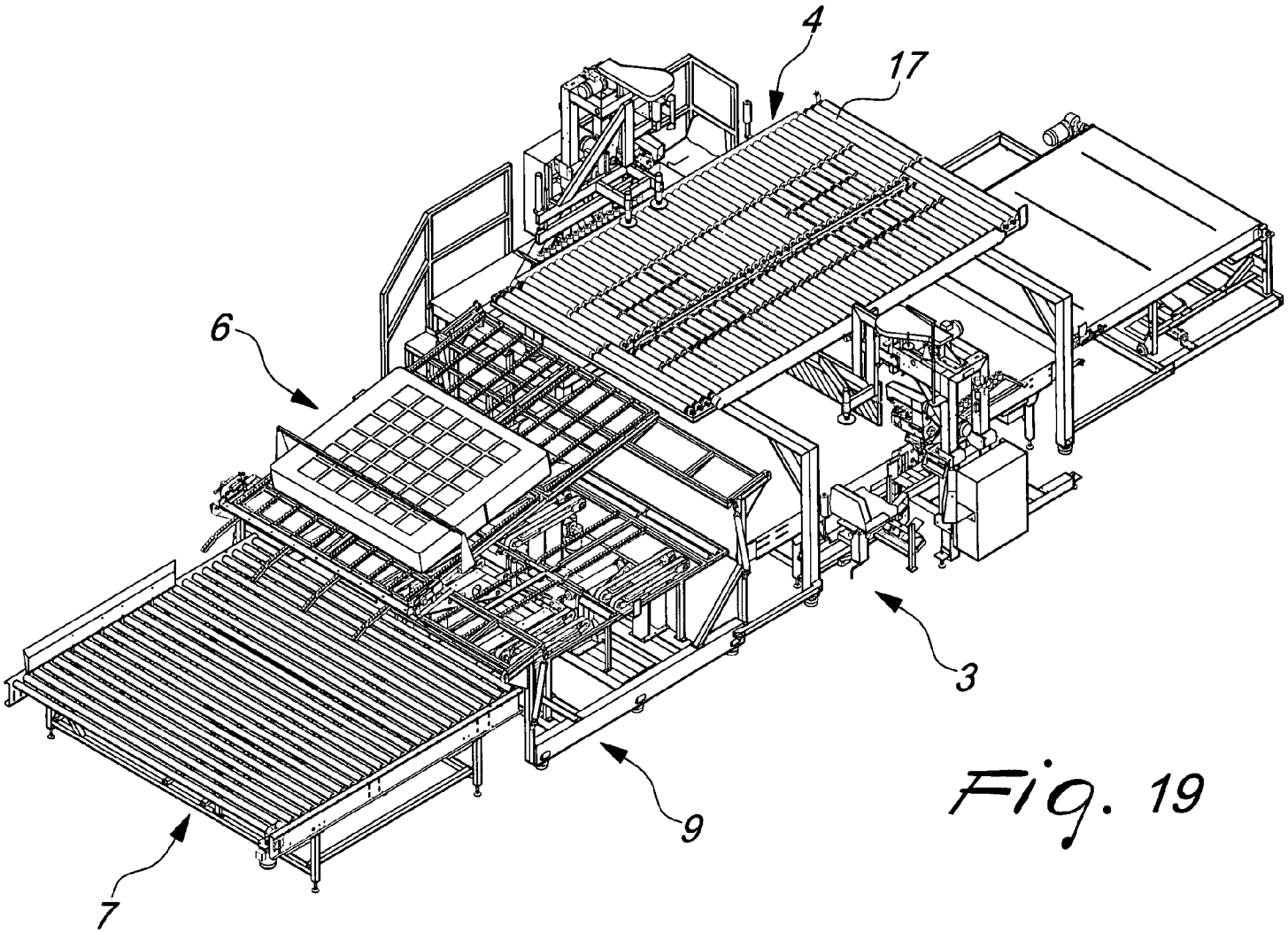
Figure 20:
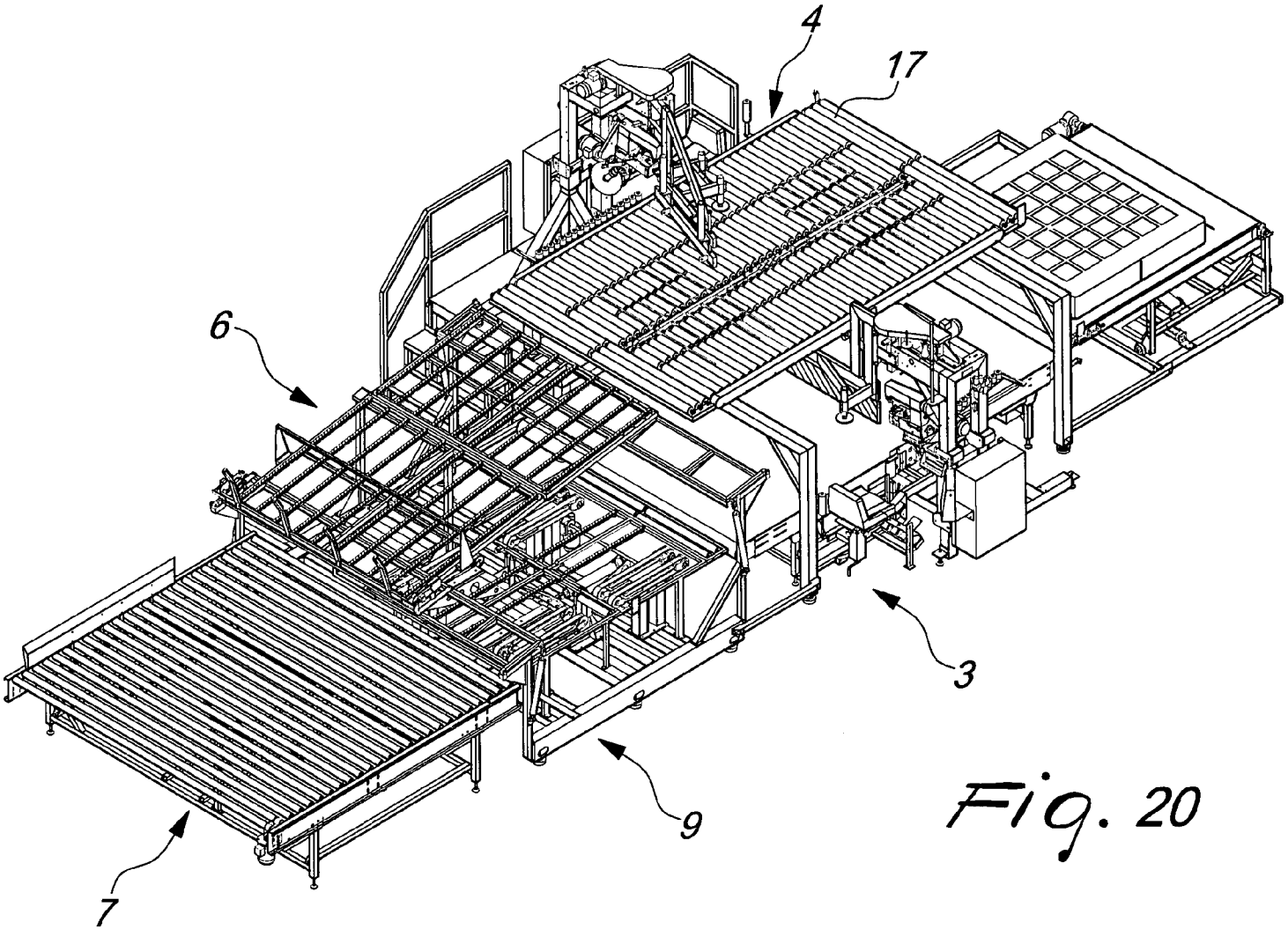
FIGS. 20-23 illustrate an operating sequence of the lower bordering assembly.
Figure 21:
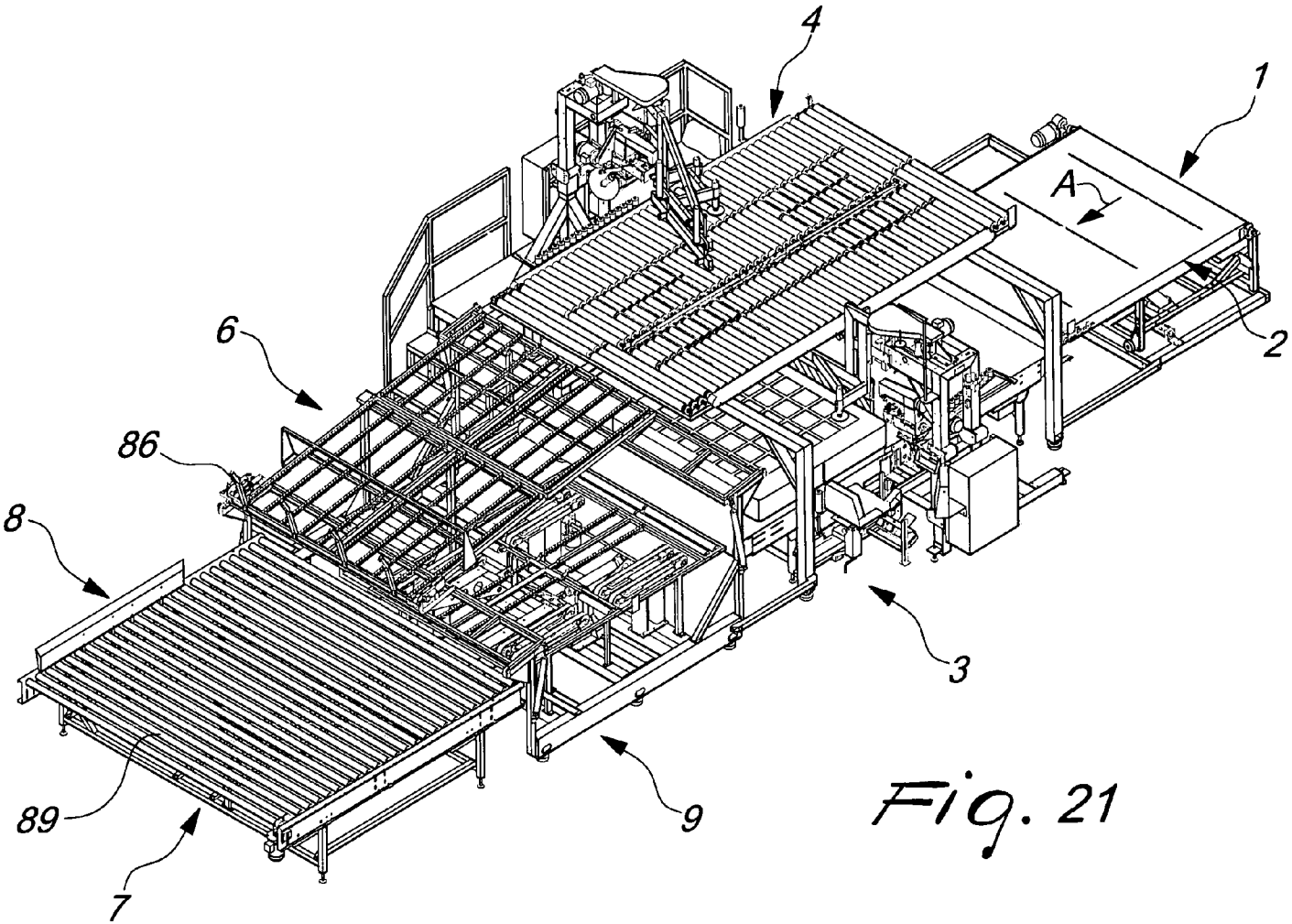
Figure 22:
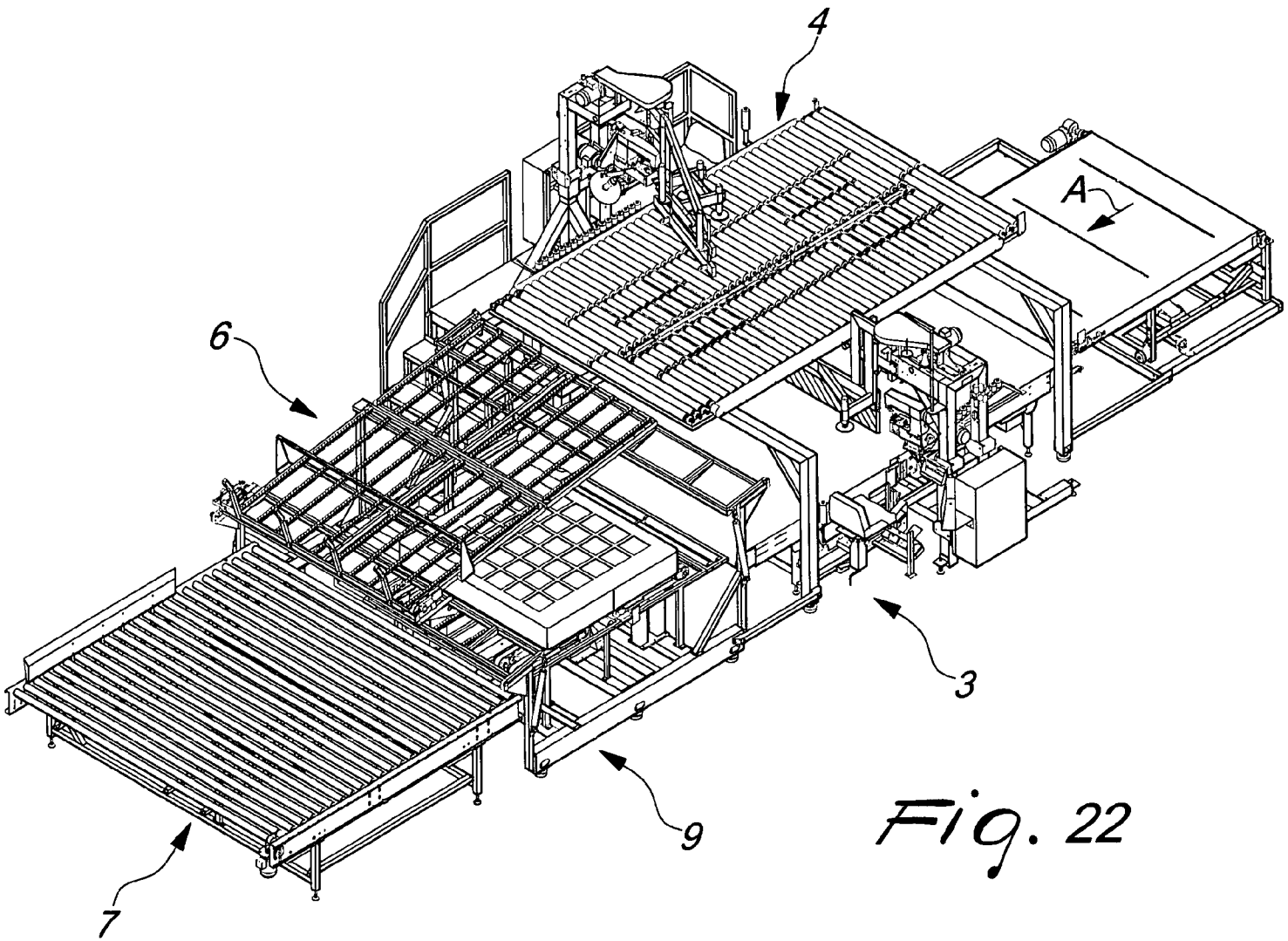
Figure 23:
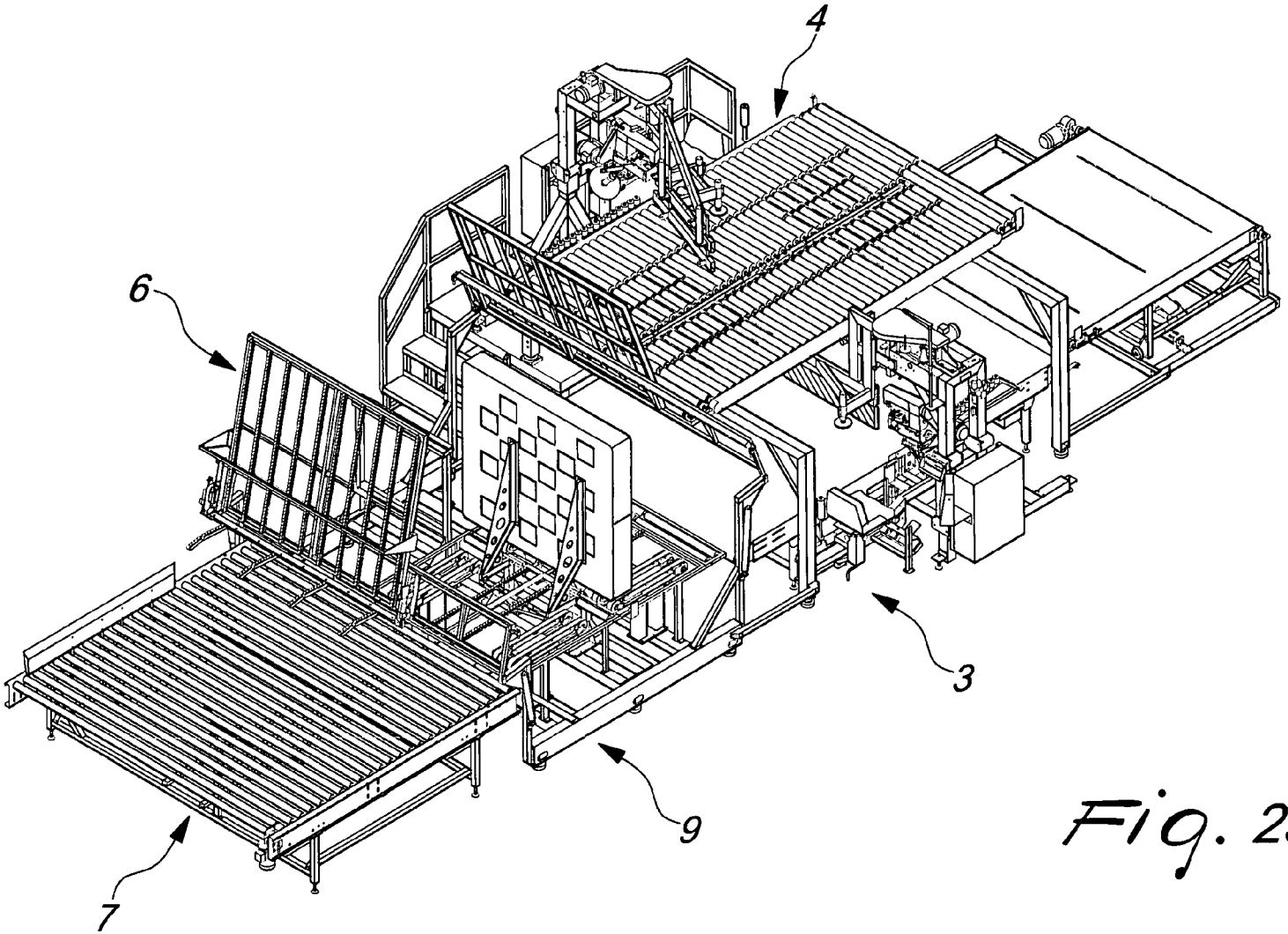

In detail, the distribution assembly 1 is constituted (see FIGS. 13, 14) by a base framework 10, which comprises two rails 11, which are perpendicular to the mattress advancement direction A and on which a carriage 12 which supports the feed table 2 can move.

The feed table 2 comprises a motorized belt 13, which is closed in a loop around two parallel rollers 14, 15, of which the roller 15 is actuated by a motor 16.

The table 2 is articulated to table actuation means comprising the carriage 12 about the axis of the driving roller 15 and can be lifted and lowered on the side of the guiding roller 14 by means of a jack 16*a*, which acts between the carriage 12 and the table 2. In the lowered position, the table 2 is aligned horizontally with the worktable of the lower assembly 3. In the raised position, the table 2 is inclined and connected to a series of rollers 17 (see FIGS. 1-3, 5), which act as a bridge with the worktable of the upper bordering assembly 4.

The reference numeral 18 designates a jack for moving the carriage 12 along the rails 11 and for positioning the worktable 2 with respect to the bordering assemblies 3, 4.

Figure 5:
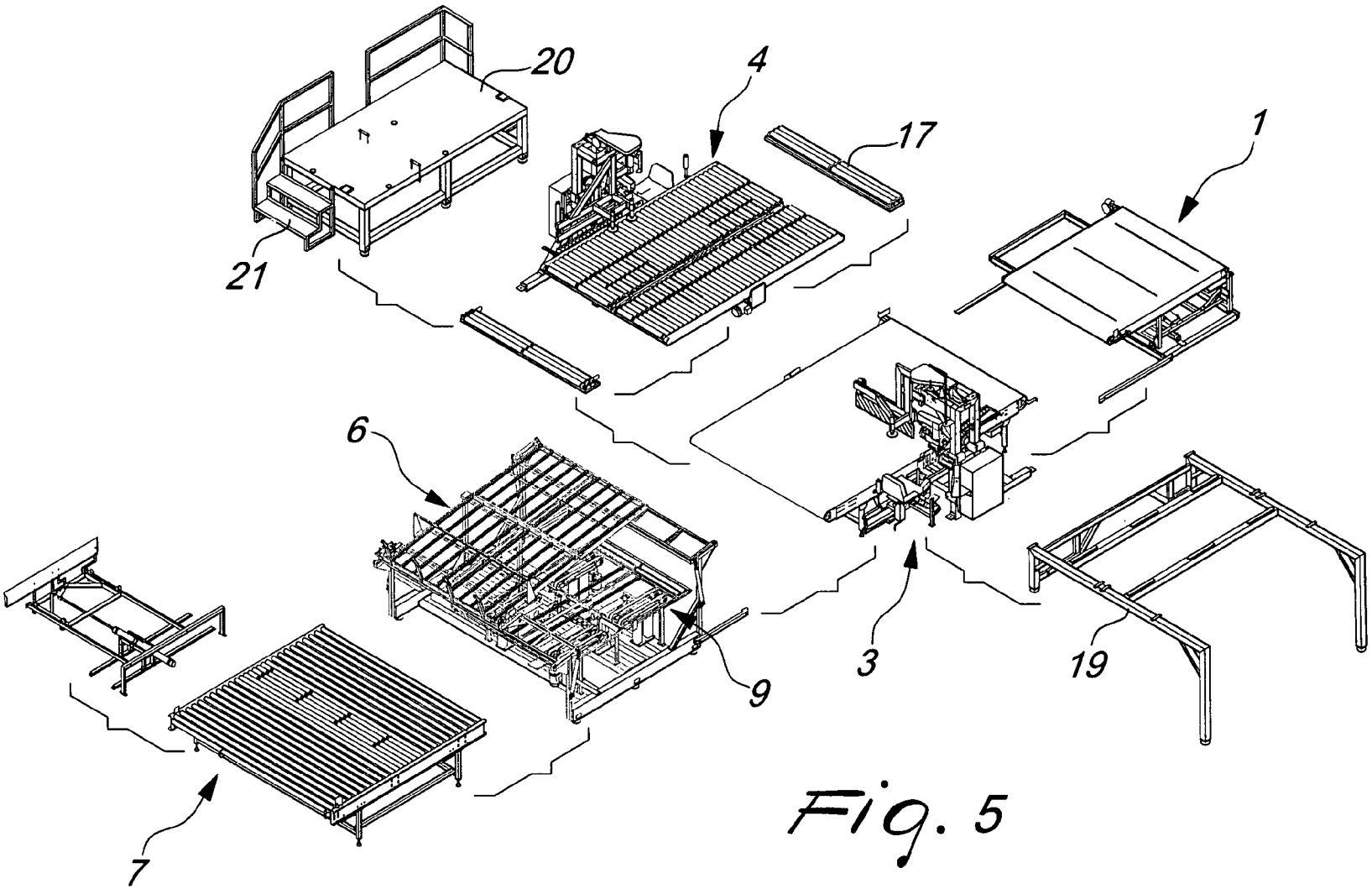
FIG. 5 is an exploded view, illustrating the various assemblies of the apparatus.

The upper bordering assembly 4 is supported above the lower one 3 by a frame 19, which is substantially shaped like a portal and can be reached by the operators of a lateral platform 20, which is accessed by means of a set of steps 21 (see FIG. 5). The upper assembly 4 has a structure which is similar to the one disclosed in the above-mentioned EP-682, 135 in the name of this same Applicant, which is referenced here for the sake of better comprehension as an integral part of the invention. It comprises two posts 22, which rise from the frame. 19 above a conveyance worktable 23 constituted by rows of mutually parallel freely rotating rollers 24 that are perpendicular to the advancement direction of the mattress. The rollers 24 are very close to each other but not in mutual contact, so that they can rotate freely and allow the movement of the mattress M deposited thereon.

Two respective carriages 25 can be positioned on the posts 22, and a bracket 26 cantilevers out from them and supports a stationary bordering machine 27, which comprises a traditional sewing machine equipped with means for guiding a tape, which is intended to be sewn so as to cover the seams that join the upper and lower faces of the mattress to the perimetric band thereof. The bracket 26 is conveniently provided with an adjustable inclination in order to be able to orient the bordering machine 27 at an angle which allows the diagonal sewing adapted to form the ridge that surrounds the faces of the mattress.

An arm 28 protrudes from the top of the posts 22 and supports, at its ends, a sleeve 29, the axis C of which is vertical and passes at the region where the stitch of the bordering machine is produced.

A substantially triangular side-hinged structure 30 hinged about one side is supported rotatably within the sleeve 29 and is composed of an upright 31, which by means of two arms 32, 33 is rigidly coupled to a pivot which can rotate within the sleeve 29, and of a beam 34, which cantilevers out from the lower end of the upright 31 and is supported by a stringer 35, which joins the beam to the top of the upright.

The side-hinged structure 30 can be oriented through an angle of substantially 90° by way of a motorization assembly 36 installed on the arm 28 which acts on the articulation pivot of the side-hinged structure 30.

A rectangular frame 37 is fixed to the beam 34 of the structure 30, proximate to the upright 31, and two jacks 38 are fitted frontally thereon, their stems protruding downward and supporting respective disks 39. The beam is further provided with two guiding bushes for two vertical and parallel rods 40, which rise from a bar 41, which is arranged below the beam 34 and acts as a pusher means in order to make the mattress turn about the axis C, as will become better apparent hereinafter.

The bar 41 can be lifted and lowered on the conveyance worktable 23 by means of a pair of jacks 42, in which the cylinders are mounted on the beam 34 and the stems are rigidly coupled to the bar 41.

A plurality of vertical rollers 43 is part of the described assembly 4; said rollers are mounted so that they can rotate freely on the longitudinal member of the frame 19, which delimits the worktable of the side of the bordering machine 27. The rollers 43 form a vertical wall for guiding the mattress during the bordering of the longitudinal and transverse sides.

For better comprehension of the overall operation of the apparatus, the operation of the upper assembly 4 is described hereafter (see also FIGS. 16-19) in order to better appreciate the functional connection to the operation of the lower assembly 3, which will be described hereinafter.

The mattress M to be bordered, once transferred onto the roller conveyance worktable 23 by the distribution assembly 1 (the feed table 3 of which is appropriately inclined), is arranged so that the side to be bordered abuts against the rollers 43 and is then made to advance in the direction A through the bordering machine 27 in order to produce the border along the corner formed by the perimetric band with respect to the upper face.

When the corner upstream of the mattress is located at the axis C, the jacks 38 are activated and, by descending, lock the mattress M on the roller worktable 23. At the same time, the jacks 42 are actuated so as to move the bar 41 from a raised position to a position which is adjacent to the perimetric band of the freshly bordered side.

It should be noted that the height of the bar 41 and of the rollers 43 is such as to exclude mutual contacts when the bar 41 is in the lowered position.

At this point, the motorization assembly 36 is activated and acts on the structure 30, making it rotate through 90° about the axis C. At the end of this operation, the mattress M is oriented so that its longitudinal side is adjacent to the vertical rollers 43.

After reactivating the jacks 38 and 42, thus lifting the disks 39 and the bar 41, the longitudinal side is bordered in the manner described above and then the other sides are bordered until the entire perimeter of the mattress is completed.

Advantageously, the rotation axis C of the structure 14 passes within the peripheral edge of the mattress proximate to the border.

In this manner, the bordering at the corners of the mattress can follow a circular arc-like path, which allows to form rounded corners.

The substantial advantage of the device is provided by the rollers 24, which, by being able to rotate freely in both directions, greatly reduce the resistance of the mattress to rotation. Moreover, it is possible to interpose between the rollers 24 overturning means such as the overturning device 5 which, after the bordering of one face of the mattress, overturn the mattress in order to complete the bordering of the opposite face.

Figure 9:
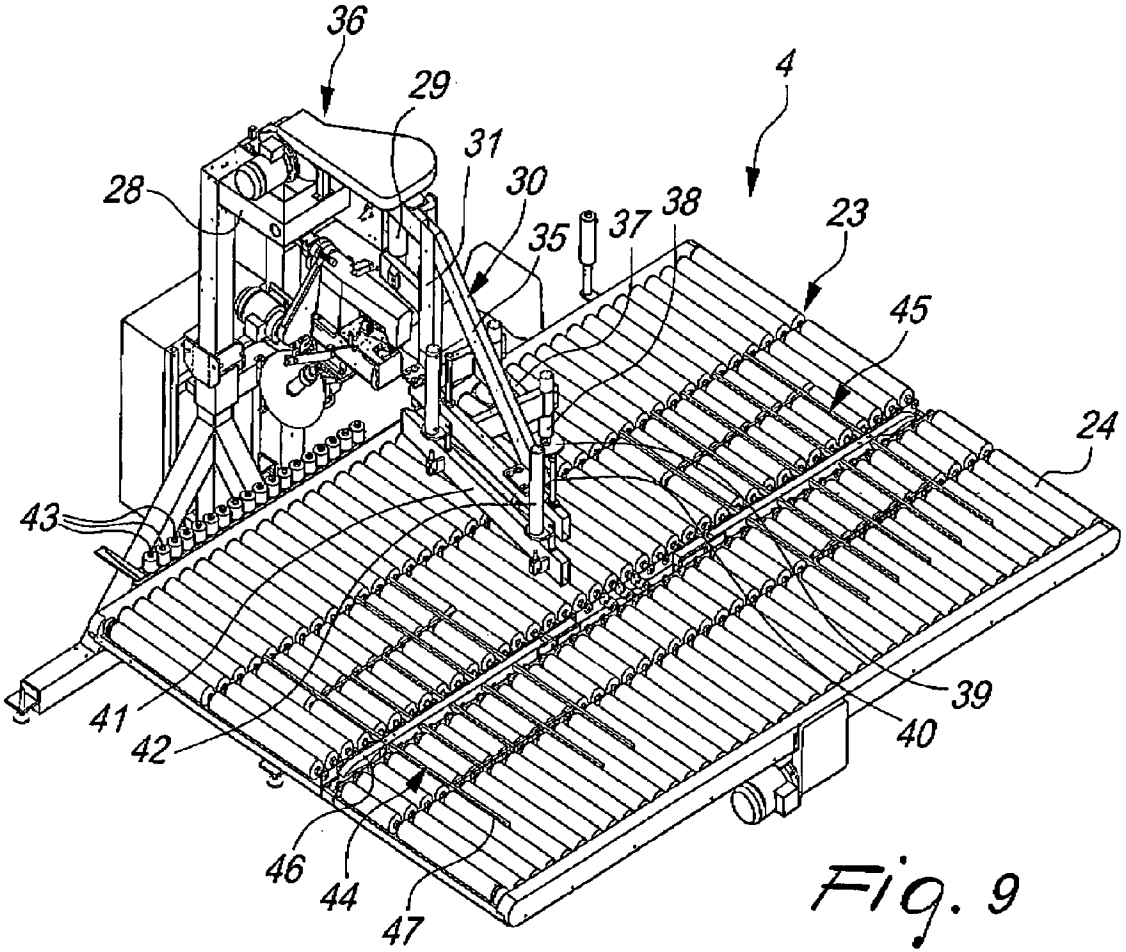
FIG. 9 is a perspective view of the upper bordering assembly, viewed from the mattress exit side.
Figure 10:
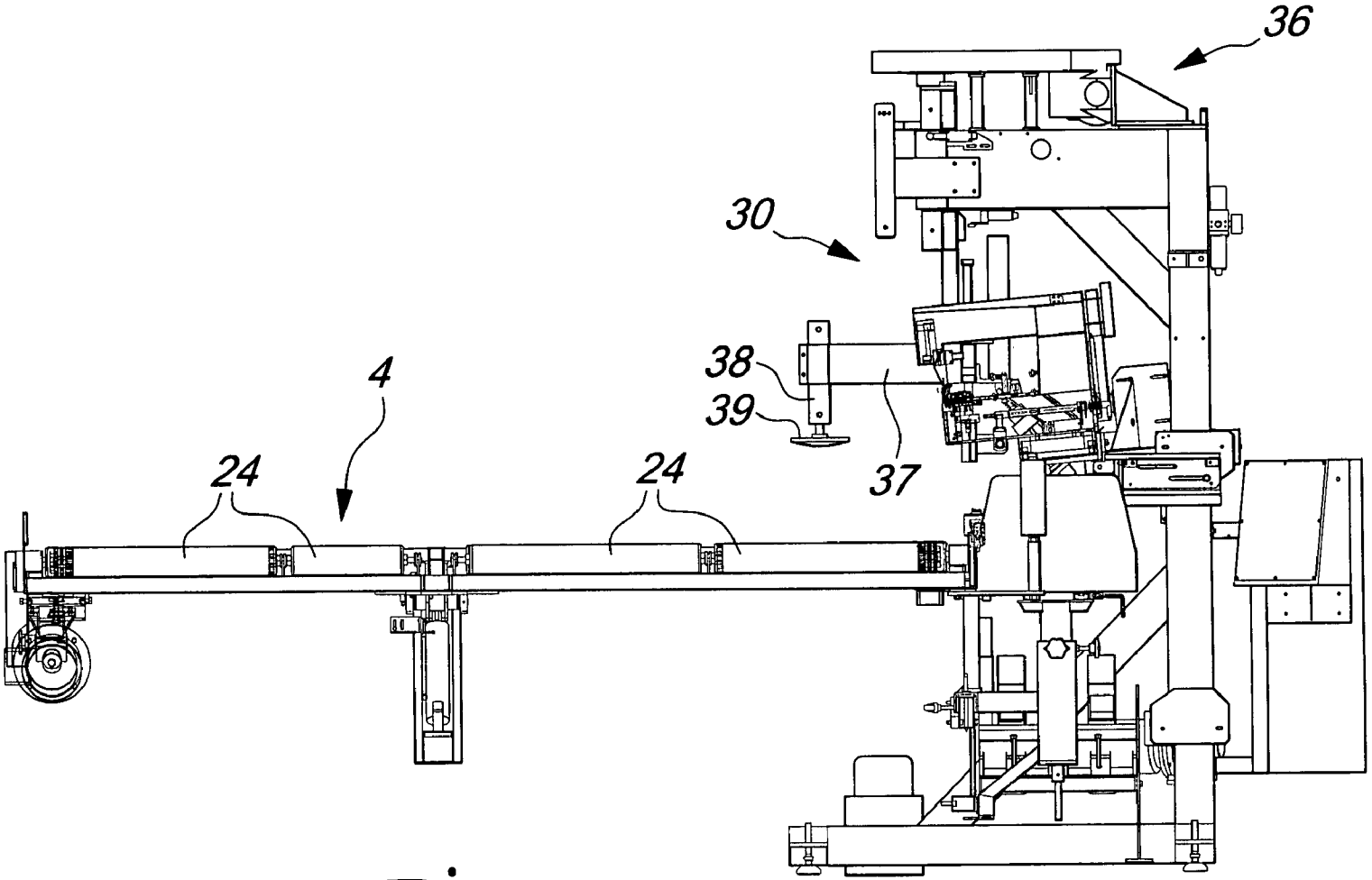
FIG. 10 is a perspective view of the assembly of FIG. 9, viewed from the mattress entry side.

For this purpose, the rollers 24 of the worktable 23 are arranged so that it is possible to arrange between them two articulated frames 44, 45, which compose the overturning device 5. The articulated frames 44, 45 (see FIGS. 9, 10) can be lifted by way of jack means, forming frame actuation means, from an arrangement in which they are coplanar with respect to the worktable 23 to an arrangement in which they lie opposite and substantially in a V-shaped configuration with respect to the worktable 23.

The frames 44, 45, for the structure and operation of which reference is also made to the cited EP-682,135, are constituted by respective arms 46, which are articulated in the roller worktable 23 and protrude in the mutually opposite directions A and B, respectively, between the rollers 24 of the various rows and are conveniently spaced so as to form a channel for accommodating the arms 46.

Rods 47 extend at right angles from each arm 46 in opposite directions and are accommodated between the various rows of rollers 24.

The overturning of the mattress occurs by placing the mattress on a frame, for example on the frame 44, and then turning it about its fulcrum so that the mattress M, after moving beyond the vertical position by inertia, rests against the other frame 45, which has been lifted beforehand in front of the frame 44 in order to assume an inclined position. The frame 45, once the mattress rests thereon, is lowered in order to deposit the mattress in an overturned position on the roller worktable 23.

Figure 6:
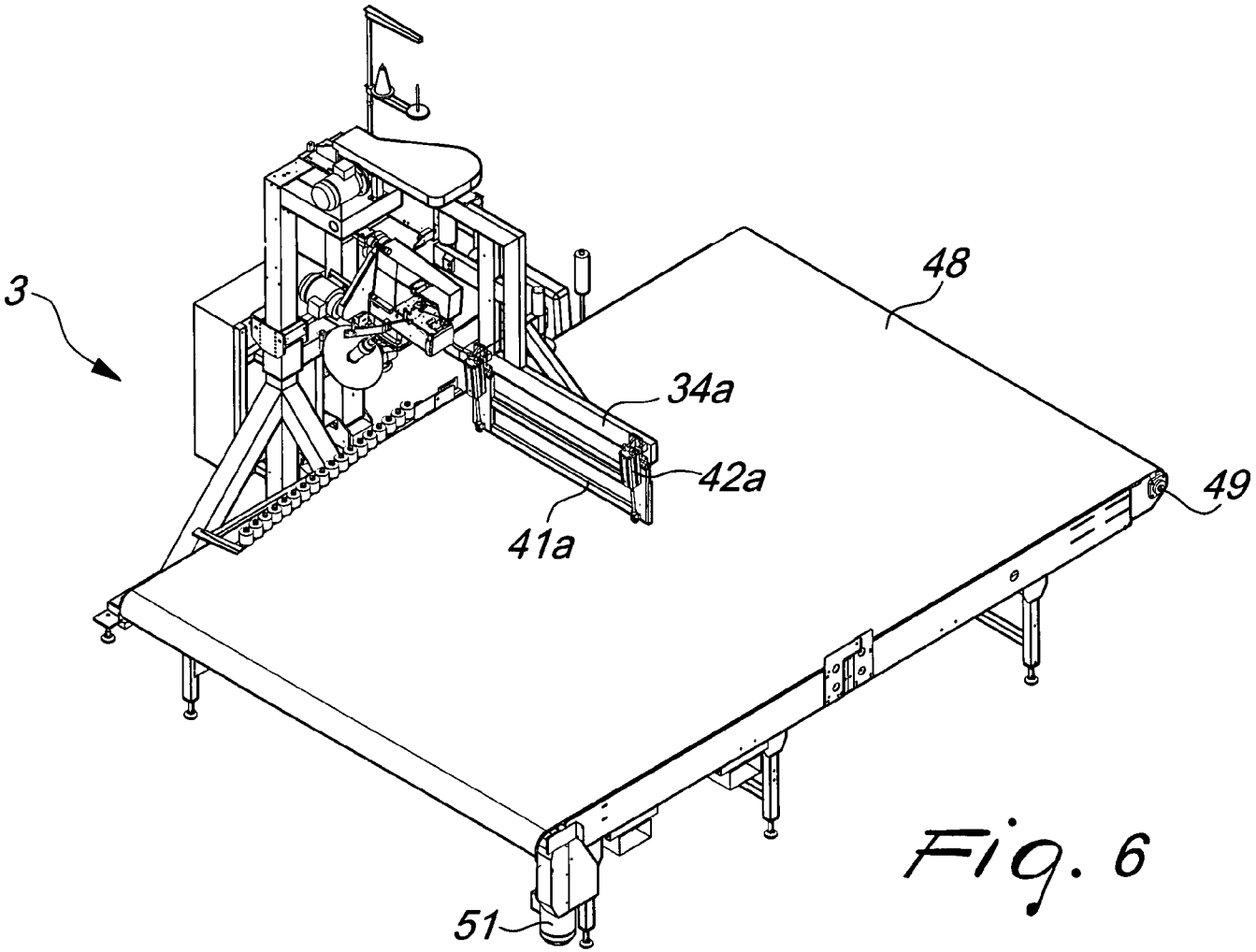
FIG. 6 is a perspective view of the lower bordering assembly, viewed from the mattress exit side, in an operating position.
Figure 7:
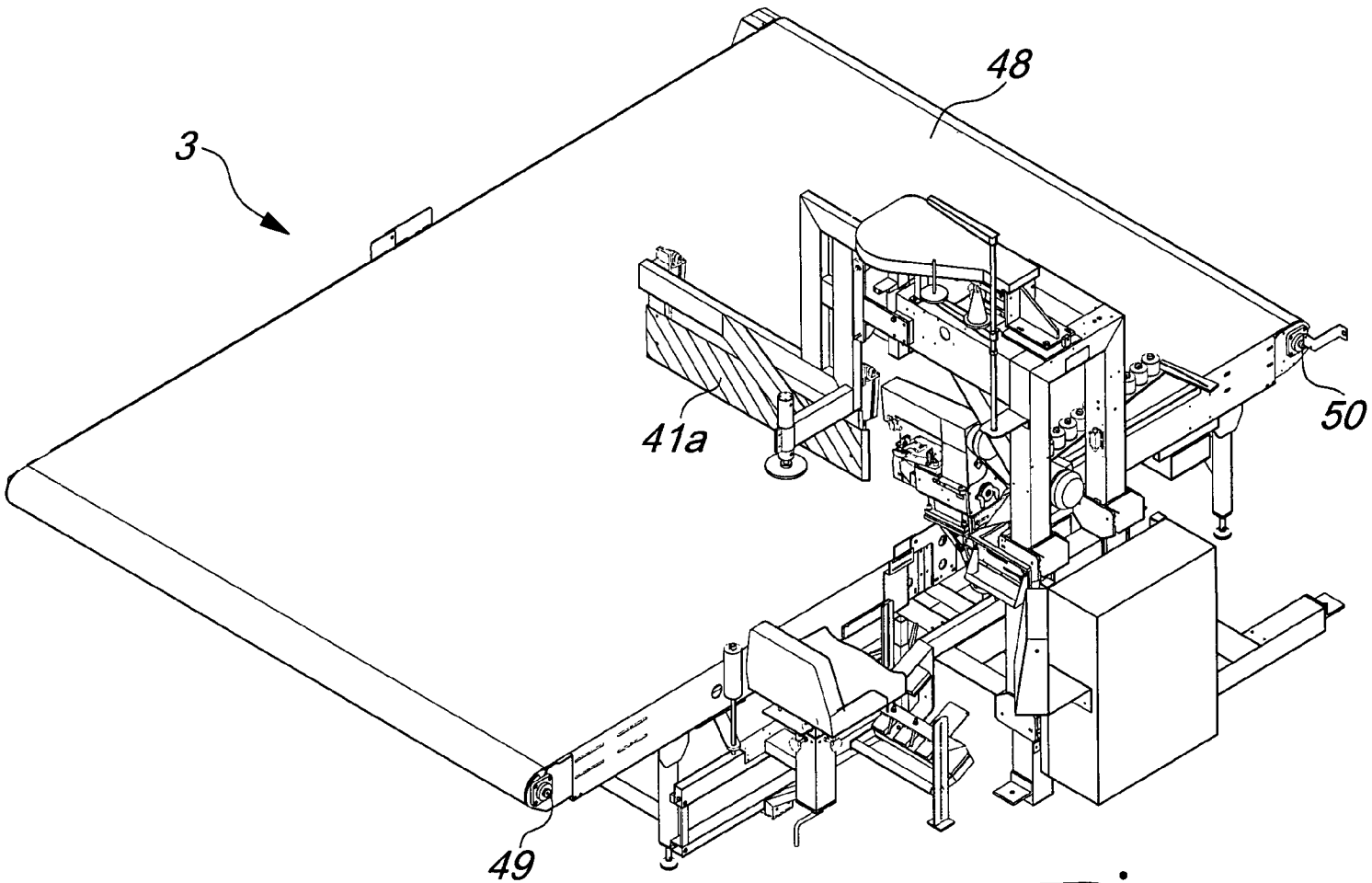
FIG. 7 is a perspective view of the assembly of FIG. 6, viewed from the mattress entry side.
Figure 8:
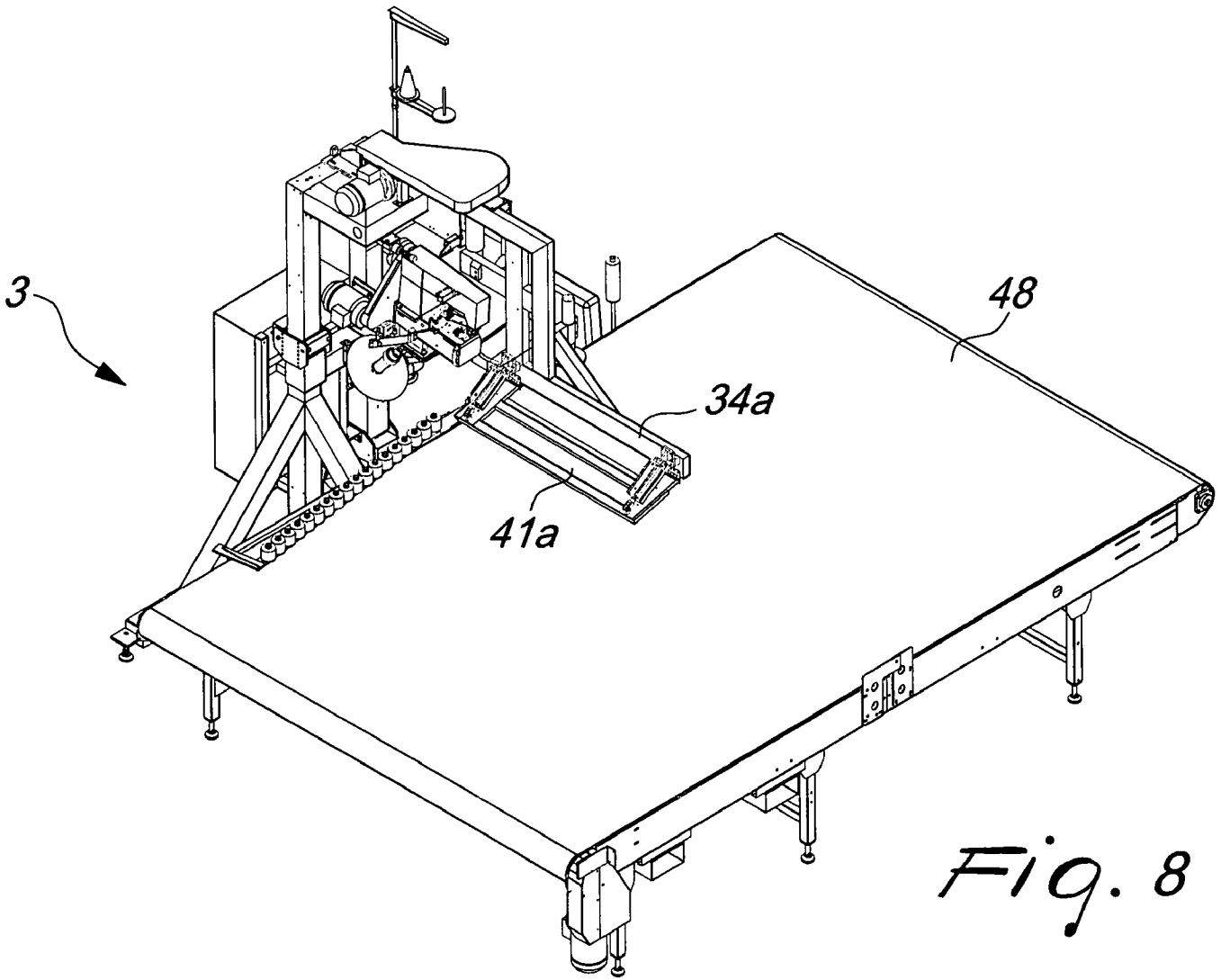
FIG. 8 is a perspective view of the assembly of FIG. 6, in a second operating position.

The lower bordering assembly 3 is shown in FIGS. 6, 7 and 8 and has a structure which is substantially similar to the structure of the upper assembly 4, except for some differences which are specified below. Therefore, for the sake of brevity in description, parts which are identical or similar to the parts of the assembly 3 are designated in the figures by the same reference numerals with the addition of the letter "a".

As can be observed from FIGS. 6 and 7, one of the differences of the assembly 3 with respect to the assembly 4 consists in that the pusher means constituted by the bar 41*a*, instead of moving vertically as in the case of the bar 41 of the assembly 4, is articulated to the beam 34*a* and is actuated by a pair of jacks 42*a* between a vertical position for pushing against the mattress and a horizontal position (see FIG. 8) for being able to pass above the mattress.

However, the most important difference is that, since the overturning of the mattress is performed downstream of the assembly 3 by the overturning device 9, the conveyance worktable of the assembly 3 is constituted by a belt 48, which is closed in a loop around a guiding roller 49, and a driving roller 50, which is actuated by a motor 51 so as to be able to transfer the mattress onto the overturning device 9, once the bordering of the upper face of the mattress has been completed, and to return the mattress onto the belt 48 in order to border the opposite face after the mattress has been turned over.

Figure 11:
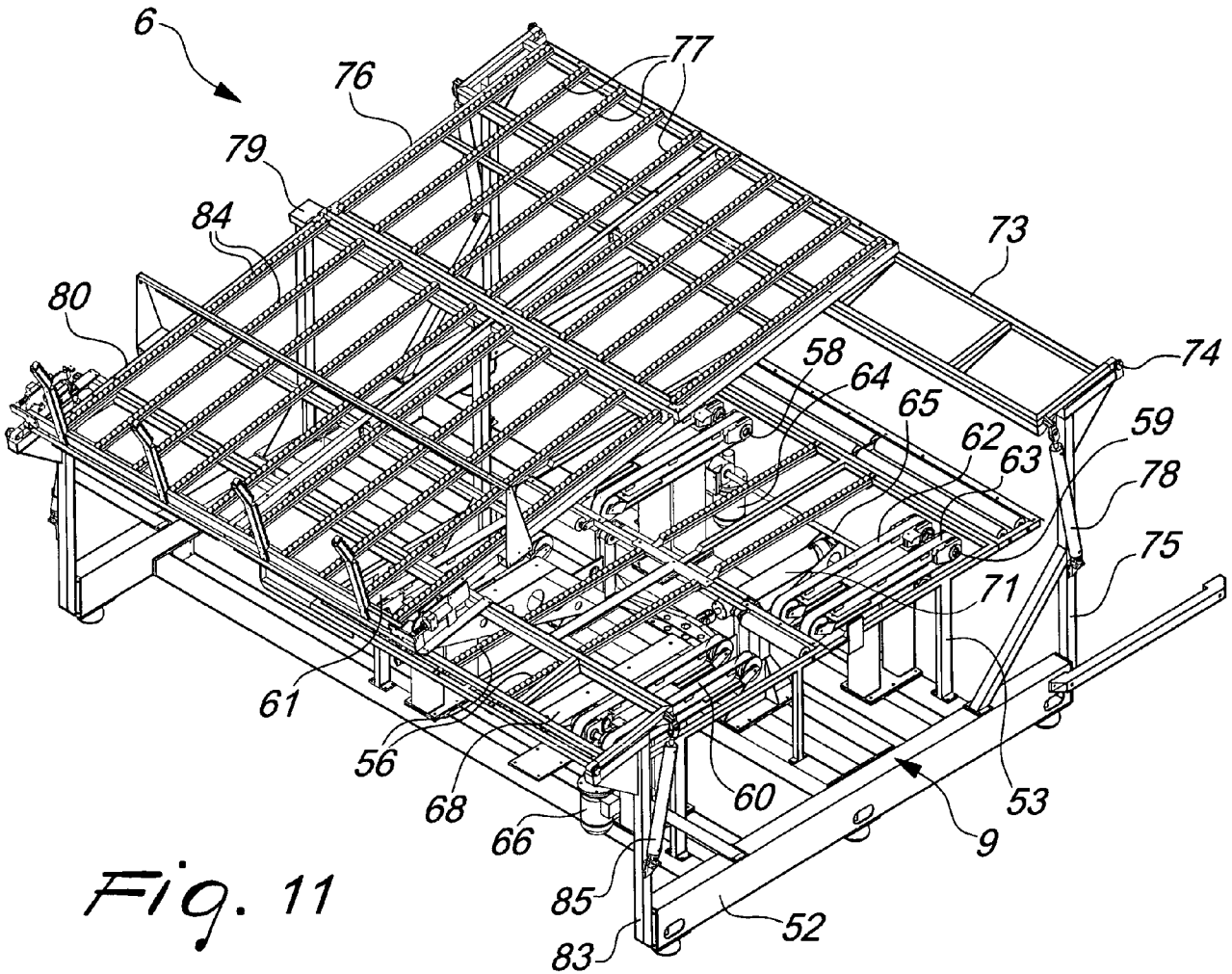
FIG. 11 is a perspective view of the assembly for overturning the mattress bordered by the lower assembly.
Figure 12:
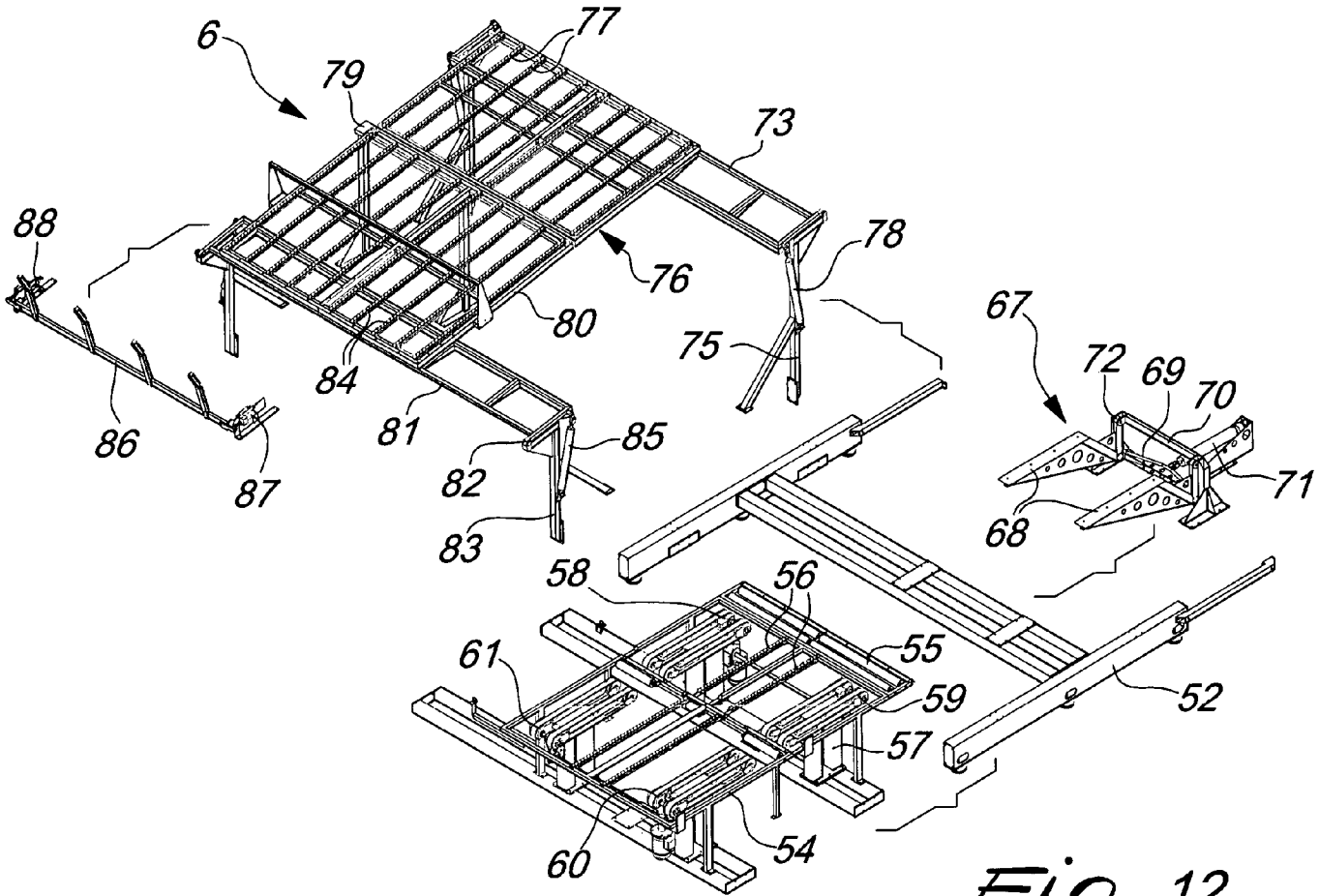
FIG. 12 is an exploded view of the overturning assembly of FIG. 11.

The overturning device 9 (see FIGS. 11, 12) is constituted by a footing 52, on which feet 53 are fixed which support a rectangular frame 54 which is coplanar with respect to the belt 48 of the bordering assembly 3. Freely rotating rollers 55 are supported in the frame 54, on the side which is adjacent to the belt 48, and act as a bridge for the passage of the mattress M on the belt 48 on a plurality of freely rotating rollers 56 arranged in two parallel rows which lie laterally with respect to the longitudinal centerline plane of the frame 54.

Four columns 57 are arranged on the footing 52 and support, at the top, advancement means comprising four respective advancement assemblies 58, 59, 60, 61, each of which is constituted by a pair of belts 62, 63, which are closed in a loop around respective pulleys (see FIG. 11) so that the upper portions of the belts are mutually parallel and coplanar with respect to the belt 48. The two advancement assemblies 58, 59 are arranged proximate to the rollers 55 and are actuated by means of a gearmotor 64 and a shaft 65, which connects the driving pulleys of the belts 62, 63.

The other two advancement assemblies 60, 61 are arranged proximate to the side of the frame 54 which lies opposite the rollers 55 and are also actuated in a similar manner by means of a gearmotor 66 and a shaft (not shown in the figure) which transmits the motion to the driving pulleys of the belts.

The mattress overturning element 67 designed to turn over the mattress is arranged on the footing 52 below the two rows of rollers 56. The overturning element 67 (see FIG. 12) is constituted by a sort of fork, which is composed of two arms 68 connected by a cross-member 69 and is hung articulately to a portal 70, which is fixed to the footing 52. The fork 67 is actuated by overturn actuating means comprising a jack actuator 71, which acts on the cross-member 69 so as to perform an oscillating motion around the pivots 72 by means of which it is articulated to the portal 70.

The arms 68 have a mutual distance and length which allows them to pass, during the oscillating motion imparted by the jack 71, between the rows of rollers 56 and the advancement assemblies 60, 61. Moreover, the arms 68 are shaped so that in the lowered condition of the fork 67 their upper edges are coplanar with respect to the upper portions of the belts 62, 63 of the advancement assemblies 60, 61.

As mentioned initially, the overturning device 9 is arranged below the chute 6 which allows to unload the mattresses that have been bordered in the upper assembly 4. The chute 6 comprises a movable element constituted by a first beam 73, which is articulated by means of pivots 74 to the top of two posts 75, which rise from the footing 52. A rectangular frame 76 is rigidly coupled to the beam 73, is provided with rows of freely rotating rollers 77, and is wide enough to act as an extension of the roller worktable 23 and provide complete support for the mattresses that arrive from the upper bordering assembly 4. Given the normal dimensions of a mattress, the frame 76 covers the advancement assemblies 58, 61 of the overturning device 9.

The frame 76 is actuated between an inclined position and a raised position by means of actuating means constituted by two jacks 78, which act between the beam 73 and the respective posts 75. In the inclined position, the frame 76 rests on a portal 79 which rises from the footing 52.

The chute 6 is completed by a movable element constituted by a second frame 80, which is rigidly coupled to a beam 81 articulated by means of pivots 82 to the top of a pair of posts 83 which rise from the footing 52. The frame 80 is provided with rows of rollers 80, which are aligned with the rollers 77 of the frame 70, and can be lifted and lowered by means of actuating means constituted by two jacks 85 which act between the posts 83 and the beam 81. In the lowered position, the frame 80 rests on the portal 79 so that it is coplanar with respect to the frame 76.

The described chute is completed by an oscillating barrier 86, which is arranged at the lower end of the frame 80. The barrier 86 has, at its opposite ends, two arms 87 by means of which it is articulated on the beam 81, at the sides of the frame 80, and on which barrier actuation means constituted by actuators 88 act which can be actuated so as to move the barrier 86 from a locking position which lies above the plane of the chute 6, in order to stop the mattresses, to a position which lies below the plane of the chute, in order to allow the mattresses to fall onto the receiving table 7.

As shown by FIGS. 1-3 and 5, the receiving table 7 is constituted by a plurality of rollers 89, which are parallel and mutually spaced so as to allow the passage of rods 90 by means of which a pusher 91 is fixed to a carriage 92 which lies below the roller table 89. The carriage 92 can slide on a pair of rails 93 and is actuated by means of a jack 94 so that the pusher 91 can move above the roller table 89 and move the received mattress to the selected position in order to be conveyed toward subsequent packaging stations.

The operation of the described apparatus is evident from the description given. In particular, the distribution assembly 1 directs the mattresses toward the lower or upper bordering assembly 3 or 4, depending on the request made by the individual operators, for example because it is required by different bordering speeds.

In any case, the mattresses fed into the upper assembly 4 (see FIGS. 16-19), after completion of the bordering of both faces, are conveyed by the chute 6 onto the receiving table 7. If the receiving table 7 is still occupied by a previously bordered mattress, the mattress that arrives on the chute is stopped temporarily by the barrier 86 and released when the table 7 has been cleared.

The mattresses that reach the lower assembly 3 (see FIGS. 20-23), after the bordering of the upper face, are transferred by the belt 48 onto the advancement assemblies 58-61. The frames 76 and 80 of the chute are then opened, actuating the jacks 78, 85. When enough space has been cleared above the mattress arranged on the advancement assemblies, the jack 71 is actuated and, by acting on the face or overturning element 67, lifts the mattress and turns it over. Then the advancement assemblies 58-61 are actuated and return the mattress onto the belt 48 in order to form the border of the opposite face of the mattress. Once bordering is completed, the mattress is again transferred onto the advancement assemblies 58-61 and from there onto the receiving table 7.

It should be noted that if a mattress that arrives from the upper bordering assembly 4 is arranged on the frame 80 during the lifting of the frames 76, 80, it is stopped by the barrier 86 and is prevented from turning over onto the receiving table 7 by an arc 95 which lies above the frame 80.

The described apparatus is susceptible of numerous modifications and variations, all of which are within the scope of the appended claims.

All the details may further be replaced with other fully equivalent ones.

The disclosures in Italian Patent Application No. BO2005A000006 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

What is claimed is:

1. An apparatus for bordering mattresses, comprising: two mattress, upper and lower, bordering assemblies, which are arranged respectively at an upper level and at a lower level and are provided with respective upper and lower worktables which are substantially mutually superimposed, the upper worktable being provided with overturning means for turning over mattresses; a mattress distribution assembly arranged upstream of said pair of bordering assemblies and adapted to send mattresses individually, on request, to the upper worktable or lower worktable; a receiving table, which is arranged substantially at the lower level of the lower worktable of said lower bordering assembly; a chute arranged at an output of the upper worktable of said upper assembly and inclined so as to convey mattresses bordered by said upper assembly toward said receiving table, said chute comprising movable elements with actuator means for actuation thereof between a planar position, in order to allow advancement of mattresses from said upper worktable toward said receiving table and an open position; mattress advancement means arranged below said chute between said lower worktable and said upper worktable in order to move mattresses that arrive from said lower bordering assembly and transfer the moved mattresses onto said receiving table; and a mattress overturning element which is functionally associated with said mattress advancement means and is provided with overturn actuation means for actuation thereof between a position for receiving a mattress that arrives from said lower bordering assembly and a position for overturning mattresses when the movable elements of said chute are in the open position.

2. The apparatus of claim 1, wherein said chute is constituted by two names, which are articulated about parallel axes and are provided with actuators for actuation thereof between the planar position and the open position in order to allow overturning of mattress transferred onto said mattress advancement means.

3. The apparatus of claim 1, wherein said mattress advancement means comprise a plurality of advancement assemblies, which are composed of belts closed in a loop around respective pulleys, upper portions of said belts being coplanar with respect to the lower worktable of the lower bordering assembly.

4. The apparatus of claim 3, wherein said mattress overturning element is constituted by a fork with an actuator for actuation thereof, said fork being provided with arms which are movable between a lowered position below a plane of arrangement of said pulleys when the movable elements of said chute are in a planar position for conveying mattresses which arrive from the upper bordering assembly and a raised position for turning over mattresses that arrive from the lower bordering assembly when the chute is in the open position.

5. The apparatus of claim 4, wherein an oscillating barrier is articulated to a lower end of said chute and is provided with barrier actuation means for actuation thereof between a locking position and a position for releasing onto said receiving table the mattresses that arrive from the upper bordering assembly.

6. The apparatus of claim 1, wherein said distribution assembly comprises a motorized belt, which is closed in a loop and forms an articulated feed table, and table actuation means for orienting said feed table between a raised position for feeding mattresses toward said upper bordering assembly and a lowered position for feeding mattresses toward said lower bordering assembly.

7. The apparatus of claim 1, wherein said upper bordering assembly comprises: a stationary bordering machine; a conveyance worktable; a side-hinged structure which is actuated for rotation about a vertical axis which passes through a sewing axis of said stationary bordering machine, said side-hinged structure being provided with pusher means, which act on a mattress which is arranged on the conveyance worktable in order to turn the mattress through an angle of approximately 90°, said conveyance worktable being constituted by freely rotating rollers which are arranged perpendicular to an advancement direction of the mattress; and two articulated frames, said rotating rollers being mutually spaced in order to allow arrangement therebetween of said two articulated frames in order to turn over the mattress on a plane of arrangement of said rollers, said articulated frames being provided with frame actuation means for actuation thereof between a position, in which the articulated frames are coplanar with respect to said conveyance worktable, and a mutually opposite position, which is adapted to allow overturning of the mattress.

8. The apparatus of claim 7, wherein said lower bordering assembly comprises: a stationary bordering machine; a conveyance worktable; a side-hinged structure which is actuated so as to rotate about a vertical axis which passes through a sewing axis of said lower bordering machine, said side-hinged structure being provided with pusher means, which act on a mattress which is arranged on the conveyance worktable in order to turn the mattress through an angle of approximately 90°, said conveyance worktable being constituted by a belt which is closed in a loop, said belt and said mattress advancement means being functionally associated with each other so as to transfer the mattress, after bordering of one face thereof, onto the overturning element and return the mattress on to said belt after overturning and then convey the mattress toward the receiving table after completing bordering of the other face of the mattress.

9. The apparatus of claim 8, wherein said mattress receiving table is a roller table and is provided with a pusher thereof that is functionally associated therewith in order to position mattresses on said receiving table.

* * * * *